US005255538A

United States Patent [19]

Day et al.

[11] Patent Number: 5,255,538

[45] Date of Patent: Oct. 26, 1993

[54] FABRIC AND KNITTING

[75] Inventors: Gerald F. Day; Frank Robinson, both of Derbyshire, United Kingdom

[73] Assignee: General Motors Corporation, Detroit, Mich.

[21] Appl. No.: 891,048

[22] Filed: Jun. 1, 1992

[30] Foreign Application Priority Data

Jun. 13, 1991 [GB] United Kingdom ..... 9112762

[51] Int. Cl.[5] ..... D04B 1/22; D04B 15/36

[52] U.S. Cl. ..... 66/71; 66/78; 66/196; 66/198

[58] Field of Search ..... 66/71, 196, 198, 77, 66/169 R, 78

[56] References Cited

U.S. PATENT DOCUMENTS 4,510,775 4/1985 Shima .
4,554,802 11/1985 Goller et al. .
4,794,767 1/1989 Lombardi .
4,941,331 7/1990 Courmoyer et al. ..... 66/198 X

FOREIGN PATENT DOCUMENTS 2622883 5/1976 Fed. Rep. of Germany .
0661023 3/1964 Italy ..... 66/196
4024187 12/1965 Japan ..... 66/198
0986987 1/1983 U.S.S.R. ..... 66/198
1175677 3/1966 United Kingdom .
1276845 10/1968 United Kingdom .
1273566 11/1968 United Kingdom .
2057021 8/1980 United Kingdom .
2095706 9/1980 United Kingdom .
2136833 3/1984 United Kingdom .
2134549 8/1984 United Kingdom ..... 66/71
2223035 3/1990 United Kingdom ..... 66/196
2243164 3/1991 United Kingdom .

*Primary Examiner*—Clifford D. Crowder
*Assistant Examiner*—John J. Calvert
*Attorney, Agent, or Firm*—Davis Hoxie Faithfull & Hapgood

[57] ABSTRACT

A method of knitting an upholstery fabric having at least two adjoined regions of different knitted structures located side-by-side in a wale-wise direction and having courses extending continuously through both regions in which the fabric is knitted with stitches having a first loop length in one region and a second, different loop length in the adjacent region, the loop lengths of the two adjacent regions being relatively adjusted so that, in the relaxed condition of the fabric, the same number of courses in each of the two regions of different knitted structures in the wale-wise direction extend for substantially the same wale-wise distance, so as to give the overall structure a balanced even appearance.

17 Claims, 15 Drawing Sheets

A
B
C
D
E
F
G
H
1
2
3
3a
4
5
6
7
8
9
9a

FABRIC AND KNITTING

BACKGROUND OF THE INVENTION

1. Field of the Invention

This invention relates to a fabric and to a method of machine knitting a piece of fabric suitable for use as an upholstery fabric, for example for covering the seats in vehicles, particularly automobiles.

2. Description of related Art

In fabric used for upholstery purposes it is often desired to produce different regions of the fabric with different structures, in order to provide a pleasing aesthetic effect. Often the different regions are made separately and joined together by sewing. If the fabric is a weft knitted fabric, it is a simple matter to knit some courses of the fabric using one knitting structure and to knit other courses using one or more different structures, in order to provide a fabric with contrasting bands disposed parallel to the course direction of the fabric. It is a different matter, however, if it is desired to produce a weft knitted high stitch density fabric suitable for upholstery applications in which a plurality of wales of one knitted structure are disposed side-by-side with a plurality of wales of a different knitted structure. If it is attempted to produce such a fabric on a knitting machine, it is often found that puckering occurs along the line where the fabric changes from one structure to the other. In order to avoid this puckering effect, it has been necessary in the past to knit the two differently structured fabric regions as separate fabric pieces and then to sew the two fabric pieces together in the wale-wise direction, which is a time-consuming and costly procedure.

OBJECTS OF THE INVENTION

The present invention aims to provide in one piece a weft knitted fabric having regions of different structures disposed side-by-side in the course-wise direction and in which there is no significant puckering of the fabric along the line or lines where the regions of different structures are joined and a method of producing such a fabric.

SUMMARIES OF THE INVENTION

By the present invention there is provided a weft knitted upholstery fabric having two adjoined contiguous regions of different structures located side-by-side in a wale-wise direction and having courses extending continuously through both regions, which structures being such that, if knitted with the same loop length in each region the fabric would be unbalanced, in which the loop length of one structure in one region is altered relative to the loop length of the structure in the other region so that the regions of the different structure are balanced.

There may be more than two regions, each being balanced relative to its conjoined contiguous region.

The two adjacent structures are balanced when they lie smoothly adjacent one another in the free state without puckering.

The fabric preferably has a machine gauge in the range 10 to 18 i.e. has a stitch density corresponding to that having been produced on a machine having needles located in tricks with distances of between 2.5 mm and 1.4 mm between the centre of two adjacent needles or tricks. Further preferably the machine gauge is 12 to 14.

Further preferably the fabric is formed of yarn having a count in the range 680 to 750 decitex, further preferably 700 to 730 decitex, further preferably 710 to 720 decitex. The yarn is preferably an air textured polyester yarn.

The fabric may be of one or more different colours and may be formed of one or more yarns, preferably two or more yarns, The fabric may have at least eight courses per cm. There may be eight to sixteen or nine to fourteen or ten to twelve courses per centimeter.

The fabric may be a double jersey fabric.

The fabric may comprise an island of one structure in a sea of different structure.

The present invention also provides a method of knitting an upholstery fabric having at least two adjoined contiguous regions of different knitted structures located side-by-side in a wale-wise direction and having courses extending continuously through both regions in which the knitting is carried out on a machine having a pair of opposed independently operable needle beds and in which the needles in each bed can be moved independently of one another in that bed into the path of an operating cam box reciprocal along the needle beds and containing independently operable cam members for each direction of movement of the cam box and in which the camming surfaces of the cam members can be independently altered to affect the loop length of stitches knitted on the needles operated by the cam and in which the needles for one region are actuated by a cam surface in the cam box so as to give stitches with a first loop length and the needles for the adjacent region are operated by a cam surface in the cam box so as to give a second loop length different to the first loop length, the loop lengths of the two adjacent structures being relatively adjusted so that, in the relaxed condition of the fabric, the same number of courses of each of the two regions of different knitted structures in the wale-wise direction extend for substantially the same wale-wise distance.

There may be two camming surfaces in the cam box, with a first camming surface controlling the loop length of the loops in one region and the second camming surface controlling the loop lengths of the loops in the adjacent region. The camming surfaces may be superimposed one on top of the other so as to engage with butts of different lengths on the needles, the needles in one region having the longer length butt and forming the longer stitch loop length and the butts in the other region being lower and forming shorter length stitch loop lengths.

Alternatively or additionally there may be two separate cams one above the other, the needles of one region being operated by one cam and of the adjacent region by the other cam.

Further alternatively, there may be a plurality of yarns with the yarn for one region being knitted by needles associated with one cam in the cam box and the yarn for an adjacent region being knitted by needles associated with an adjacent cam in the cam box.

Further alternatively, or additionally, the cam surface in the cam box which controls the stitch loop length may be altered during movement of the cam box whilst knitting so that the camming surface presented to the knitting needle butts for the first region is different to that for the second region. The camming surface may be moveable by a stepping motor.

In one embodiment of the method according to the invention, stitches knitted in said first region on adjacent pairs of needles of said first needle bed are looped around every other needle of said second needle bed, to form tuck stitches. If such tuck stitches are looped around the same needles of said second needle bed in each course knitted on the first and second needle beds, then the fabric of said first region will have a corded appearance in the wale-wise direction. If, on the other hand, the tuck stitches of one course are displaced by one needle in successive courses of the first region of the fabric, then the fabric of said first region will have a reticulated appearance.

Preferably, the method of knitting is such that, in the relaxed state, the fabric has from 4 to 6 wales per cm. In practice this means that preferably the knitting is performed on a machine having a gauge in the range of from 10 to 14 (i.e. a machine having from 3.94 to 5.51 needles per cm), and a 12 gauge machine is preferred for knitting fabric by the method according to the invention.

Particularly suitable yarns for use in carrying out the method according to the invention are air-textured, continuous filament yarns, preferably polyester yarns, having a count, in the unrelaxed state, of from 680 to 750 decitex. The yarns for the different regions used in the method according to the invention may be of different materials and/or different counts. On the other hand, the two yarns may be of the same material and the same count, but of different colours in order to produce a two-colour pattern in the fabric. Using such polyester yarns to knit a fabric by the method according to the invention on a 12 gauge machine, it is preferred to adjust the settings of said stitch cam means so that, in the relaxed state of the finished fabric, the fabric has at least eight courses per cm. Up to sixteen courses may be provided per cm, preferably there are 9 to 15 or 9.5 to 12 or 10 to 11 courses per cm. There may be 4.5 to 6.5 wales per cm preferably 4.7 to 6.3 or 5 to 6 or 5.5 to 5.7 or 5.6 wales/cm.

One or both regions of the fabric may comprise a plurality of differently patterned jacquard structures. If desired, adjacent differently patterned regions of the fabric may be separated by a plurality of wales of single or double jersey fabric in balance with the differently patterned regions.

A fabric knitted by the method according to the invention may have one or more regions in addition to said first and second regions in which the knitted structure is different from that of an immediately adjacent region. For example, the fabric may be knitted with a third region having substantially the same structure as said first region, said second region being disposed between and joined course-wise to said first and third regions.

The upholstery fabric preferably has a weight in the relaxed state ready for use in excess of 500 g/m$^2$ preferably 500 to 600 g/m$^2$. This compares to traditional knitted products which have a weight of 300–350 g/m$^2$.

The present invention further provides a weft knitted upholstery fabric formed of yarn having a decitex in the range 625 to 850 and having been knitted on a machine having a machine gauge in the range 10 to 18, the fabric being of generally double jersey construction having interengaging loops between portions of the double jersey structure wherein the fabric includes tuck stitches in some region at least of the fabric.

The fabric may be located on a three dimensional structure to form an upholstered structure.

The fabric may be formed of an air-textured polyester yarn. The yarn count may be in the region 650 to 750 preferably 700 to 720 decitex. The machine gauge may be in the range 10 to 14, and is preferably 12. The fabric in the relaxed state may have 8 to 16 or 9 to 14 or 10 to 12 courses per cm. The fabric may have from 4 to 7 wales per cm.

The fabric may be formed of two or more different coloured yarns.

The weight of the fabric may be in the range 500 to 600 g/m$^2$.

The tuck stitches may be provided in relatively small (less than 50%) areas of the fabric so as to give a raised effect to the surface of the fabric.

Alternatively the tuck stitches may be provided in relatively large (greater than 50%) areas of the fabric, so that the non-tucked areas give a pile look to the fabric.

The tucked areas may be as dashes, stars, dimples, bullets, ribs or grids.

BRIEF DESCRIPTION OF THE DRAWINGS

The invention will now be described in greater detail, by way of example, with reference to the accompanying drawings, in which.

DESCRIPTION OF PREFERRED EMBODIMENTS

Figure 1:
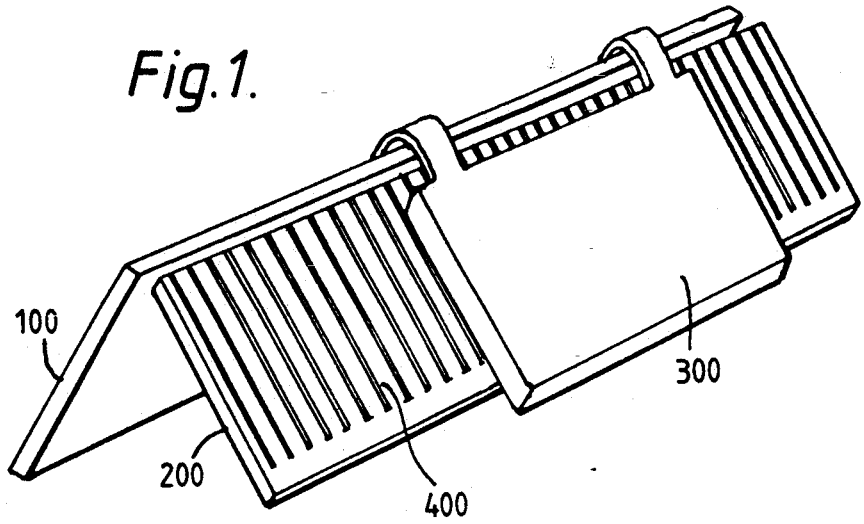
FIG. 1 is a schematic view of a flat V-bed knitting machine.

In order that the invention can be fully understood reference will be made to a flat V-bed knitting machine.

More details on such knitting machines are to be found in the publication "Dubied Knitting Manual" Published by Edouard Dubied et Cie SA, near Chatel, Switzerland in 1967. Flat V-bed knitting machines are very well known and many such machines are now computer controlled. It has been proposed recently to manufacture upholstery fabric on such flat V-bed knitting machines and proposals have been made—see for example GB-A- 2,223,034 to knit upholstery fabric suitable for use in vehicles. There are however practical limitations on the type of structure which can be manufactured and which will be suitable for upholstery fabric.

In particular it is necessary that a certain minimum stitch density be used for optimum fabric appearance or loop size and wearing capabilities of the fabric. It is also desirable that a minimum count be used for the yarn again to provide sufficient durability for the upholstery fabric in use.

This combination of a high stitch density and relatively large yarns makes for a heavily packed dense upholstery fabric which can be knitted into a vehicle upholstery seat cover in a single operation.

Unfortunately, however, it has been discovered that if attempts are made to knit side-by-side in a course-wise direction on a weft knitting machine a pair of different structures which are unbalanced, the high density upholstery fabric tends to pucker at the region of the join between the different structures. By "different structures" as is used herein is meant that the adjacent regions have a different stitch pattern on one or both sides of the needle beds.

If it is assumed that knitting commences with Structure A on the knitting machine; Structure A can be any type of structure, i.e. a simple structure or a complex structure. If 1,000 rows of stitches of Structure A were knitted, then a piece of fabric of a given length would be produced. It does not particularly matter what the actual length is, but it may be assumed that the piece of fabric is 25 cm long.

If the machine were then to be stopped and the needle operating sequence reset, so that it produced a fabric of a different structure; but leaving the stitch length control cams on the machine in the same position as used for Structure A, further knitting would then produce a new structure, which will be called Structure B.

If 1,000 rows of stitches of Structure B were knitted it would again produce a length of fabric conjoined to Structure A in a course-wise direction. However, there is no reason to suppose that the length of fabric produced in Structure B would be the same as the length of fabric produced in Structure A. It might well be that the length produced in Structure B would be, for example, 28 cm.

It can be seen that if Structure A were to be knitted first and then Structure B were to be knitted afterwards the two would look like a football scarf with a band of one structure followed by a band of another structure (course-wise conjoined regions). The fact that the first band was 25 cm long and the second band 28 cm long would not matter.

If, however, the two structures were to be knitted side-by-side in a wale-wise direction i.e. the knitting machine were to be set up so that it knitted for the first part of a row—the left hand side—Structure A, and for the second part of a row—the right hand side—Structure B, there would be problems.

After knitting 1,000 rows in this case, the left hand side of the fabric piece would try to have a natural length of 25 cm, being formed of Structure A. The right hand side would try to have a natural length of 28 cm, being formed of Structure B.

These two pieces of fabric would then be "out of balance" and there would be puckering where the two fabrics met, unless the structures were so loosely knitted that the difference could be accommodated between the two pieces. Loose knit structures tend to stretch and distort naturally. Such loose knit structures are not practical for upholstery fabrics.

In some cases the different stitch patterns produce fabrics which grow at equal lengths. Such fabrics do not become unbalanced. In other cases, however, the tendency of the fabric to grow differs in one region to another. This sets up strains in the fabric and in the case of an upholstery fabric where there is a high stitch density this can result in puckering between adjacent regions.

It has now been discovered that by controlling the loop length of the stitches in adjacent regions the imbalance can be rectified and a balanced, even, unpuckered, fabric can be knitted.

The method which enables such nominally unbalanced fabrics to be knitted side-by-side involves the control of the loop length of the stitches in the adjacent side-by-side regions. This is something which can be done on a modern knitting machine but which requires accurate setting up of the machine. Essentially the knitting machine is so set up that the cam which controls the loop length down-stroke of the knitting needle is either: (a) unique to one structure —with two cams being provided one for each structure, or; (b) a split cam having a plurality of surfaces to control the loop length of adjacent structures utilising needles with different butt lengths, or; (c) a moveable cam surface capable of adjustment in flight of the cam box so as to control the loop length of adjacent stitches.

The invention can be more clearly understood by way of example and with reference to the accompanying drawings. In FIG. 1 there is shown a schematic view of a flat V-bed knitting machine comprising a first bed 100 and a second 200. Moveable along the bed in a manner well know per se is a cam box 300 which operates the needles (not shown) located in the tricks 400 on each of the needle beds.

Such flat V-bed knitting machines are well known and are described in the Dubied Knitting Manual referred to above.

Figure 2:
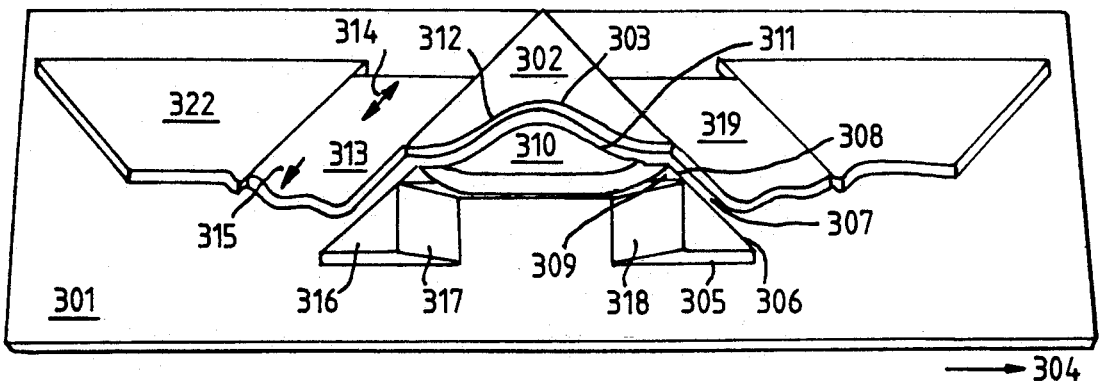
FIG. 2 is an underside view of a simple form of cam box for operation with the machine of FIG. 1.

The actual control of the knitting needles is by means of the cam box 300, the underside of one of which is shown in more detail in FIG. 2.

Located on the cam plate 301 is a central camming member 302 with a camming surface 303 which controls a needle butt in a manner well known per se. When the cam box is moving in the direction of the arrow 304 a needle first engages the rising needle cam member 305. This causes the butt on the needle (not shown) to follow the camming surface 306 on the rising needle camming member 305 into the guide channel 307. The needle then rises in its trick being further guided by the camming surface 308 on the fixed member 309 in the cam box. If the withdrawable cam member 310 is projecting from the plane of the cam plate 301 to further define the guide channel 307 the needle butt will move up, guided by the camming surface 311. Further movement of the cam box will then cause the needle to descend under the action of the camming surface 312 on the cam member 302. The needle butt will then engage with the moveable cam member 313. The cam member 313 may be moved in the cam box in the direction of the arrows 314. The further the camming member 313 is moved in the direction of the arrow 315, the more the needle under the control of the camming surface will be moved down in its trick during the knitting action. This will mean that the length of loop formed during knitting of a particular stitch being formed on that needle will be increased. Thus control of the cam member 313 in terms of its position in the cam box will control the length of the loops knitted by a traverse of the cam member.

It will be appreciated that during descent of the needle butt under the control of the camming member 313 the rising cam member 316 will play no part in the movement of the needle in a downwards direction. It is only the lowering cam member 313 which controls the length of the loop formed in a given stitch.

It can be seen that the rising cam members 305 and 316 have inclined planar faces 317 and 318. The rising cam members are both spring loaded and reciprocal in and out of the plane of the cam box 301. Thus if the rising cam member 305 were to be lowered the passage of the cam box in the direction of arrow 304 would mean that the butts on the needles would not be gathered by the camming surface 306 and hence the needles would not rise during passage of the cam box. However, once the needle butts contacted the inclined surface 317 they would displace the rising cam member 316 under the influence of the resilient spring into the plane of the cam box 301 so permitting a free passage of the cam box without raising of the needles. This would mean that one of the needles would be knitted on during movement of the cam box in the case where the rising cam 306 was in its lowest position.

Alternatively if the cam member 310 was restricted so as not to be in a position to engage the needle butts, the needles would only rise partially in their tricks and in this condition would form a tuck stitch.

Normally during movement of the cam box in the direction of arrow 304 the lowering cam member 319 would be raised so as not to engage the butts of the needle in any way. At the end of a stroke of the cam box in the direction of arrow 304 automatically the lowering cam member 313 would be raised in the opposite direction to arrow 315 and the lowering cam member 319 would be lowered to a predetermined position.

It will be appreciated that during a single direction or stroke movement of the cam box the lowering and raising cams 313, 319, 316 and 305 would be in preset positions.

In particular the presetting of the lowering cams 313 or 319 will determine the loop length for the stitches produced in a single row of stitches. Although it is common practice to preset the lowering cam positions to a predetermined level for optimum loop formation in the stitches the lowering cams stay in that position for the complete stroke of the cam box in a given direction.

It has now been discovered that, when knitting upholstery fabrics, particularly those having a high stitch density knitted on a fine gauge i.e. 10 to 18 gauge machine and using yarns of a fairly heavy count typically 680 to 750 decitex, there are limitations on the structures which can be knitted in a side-by-side position within the fabric.

It is often desirable in an upholstered fabric to have different physical appearances (as opposed merely to colour changes) for different portions of the upholstery fabric. For example in a vehicle seat the sides of the vehicle seat may be of a different structure to the central portion of the seat. It may also be desirable to have islands of a different structure within a sea or matrix of a common ground structure again to give either a different appearance or a different feel or texture to the fabric.

Unfortunately it has been discovered that many structures cannot be knitted side-by-side with regions of different structure in the fabric in a wale-wise direction because there appears to be a puckering at the region of the joint in the upholstered final product.

It is believed that this is caused by different linear growth rates of different structures having a common loop length. It is further believed that this problem can be solved by balancing the knitting structure, not by altering the knit sequence, but by altering the loop length of the different stitches in the different regions by having a different camming surface control the needles for one structure compared to the needles for the adjacent structure.

One embodiment of the present invention, therefore, contemplates the provision of a stepping motor physically to move the lowering cam plate such as cam plates 313 or 319 in response to a specific movement of the cam box during knitting. Thus whilst knitting the cam box would respond to the position of the cams on the bed and would by means of suitable stepping motors physically alter the position of the lowering cam member so that the loop lengths generated in one structure are different to the loop lengths in the adjacent structure, in such a way that a balance between the two structures is obtained. When there is a balance between the two adjacent structures, the structures will be such that in the relaxed condition of the fabric the same number of courses of each region in a wale-wise direction will extend for substantially the same vertical distance i.e. contain the same number of stitches and be the same physical length even though the loop length of the stitches in the different regions is now different. It will be appreciated that as a knitted structure has some flexibility it is not essential to change the stitch length exactly as the structure changes, the change in length can be accomplished over a few needles on either or both sides of the structure change.

Instead of using the stepping motor mechanism to alter the position of the lowering cam it may be possible to provide for a multi-cam surface instead of the single cam surface as illustrated in FIG. 2.

Figure 3:
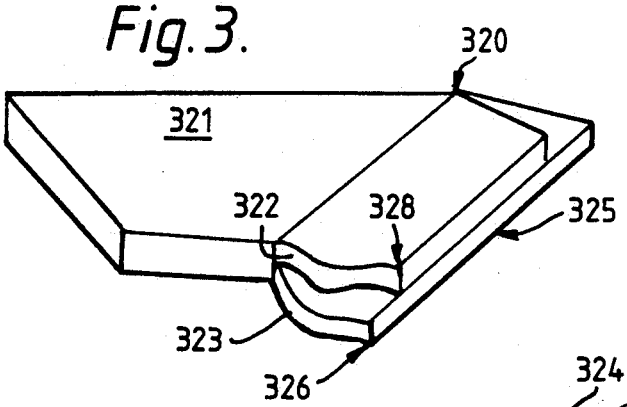
FIG. 3 is a schematic view of a double cam stitch loop length controlling mechanism.
Figure 4:
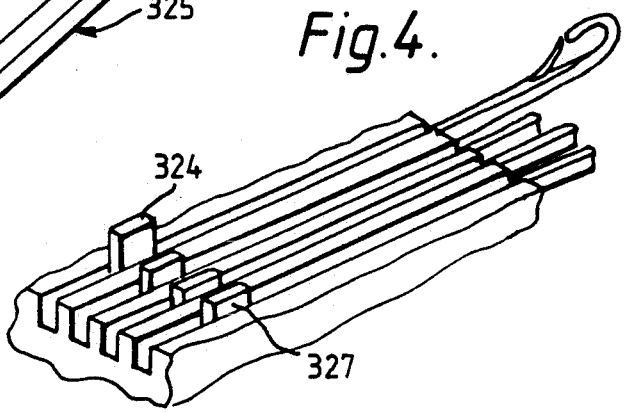
FIG. 4 is a schematic view of low and high rise butts on needles located in a plurality of tricks.

Referring to FIG. 3 it can be seen that the lowering cam indicated generally by 320 sits adjacent to a surface member 321 which corresponds to the surface member 322 in the cam box illustrated in FIG. 2. In the case of the camming surface 320 however there are provided two different camming surfaces 322 and 323 which are independently moveable. The exaggerated view in FIG. 3 shows that the loop length provided by the camming surface 322 will be shorter than the loop length produced by the camming surface 323. By providing needle butts on the needles as shown in FIG. 4 it can be seen that the higher needle butts such as butt 324 will engage with the camming surface of both the upper and lower portion of the cam in the region of the surface 325. However, as the cam box continues to move the higher needle butt 324 will engage with the portion 323 of the cam member 320 and will therefore be lowered by a distance controlled by the position of the edge 326. By comparison, however, the shorter butts 327 will engage only with the camming member 322 and the lowest position of the needles having the low butts 327 will therefore be determined by the position of the corner 328.

It can be seen therefore that controlling the relative positions of the lowering cam members 322 and 323 and by the provision of needles having different butt heights adjacent regions of fabric can be knitted with different loop lengths. This means that the structures in each region can be such that they are fully balanced in that the loop lengths in each adjacent structure are such as to give a fabric which has the same number of courses in the wale-wise direction occupying the same vertical distance.

Figure 5:
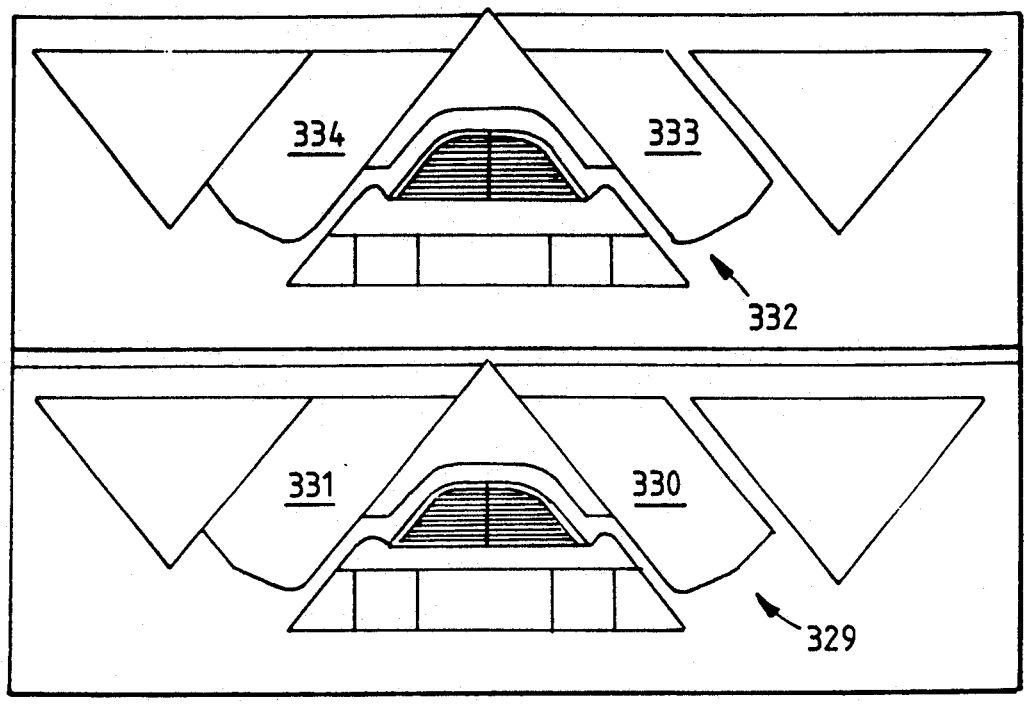
FIG. 5 is a view of a cam box containing two cams one above the other.

A further method of producing the same effect is illustrated in FIG. 5. In FIG. 5 there is shown a cam box having two cam members one above the other. The cam member generally illustrated by 329 has lowering cams 330 and 331 which operate in the same way as the lowering cams 313 and 319 of the cam box illustrated in FIG. 2. The upper cam member generally illustrated by 332 again has lowering cam members 333 and 334 which operate in the same way as the cam members 330 and 331. By the provision of pusher bars in the tricks for the needles, which can be operated by a suitable jacquard so that the butts of the pusher bars rise from the tricks for engagement with either one of cam systems 329 or 332, the machine can be operated in such a way that the lowering cams 330 and 331, 333 and 334 can be individually positioned so that adjacent structures can be knitted with different loop lengths. To accomplish this the machine would be operated by an electronically operated electromagnetic jacquard so that the needles in one structure were operated by pusher bars which were in turn controlled so as to engage the cam member 329. The next adjacent needles would be operated by a pusher member controlled by the cam 332. By individually controlling the settings of the lowering cam members, therefore, the same yarn can be knitted into two different adjacent structures in a side-by-side position with one set of needles being controlled by one cam member and the adjacent set being controlled by a different cam member. Thus the individual loop lengths can be tailored for the different structures so as to produce a balanced upholstery fabric.

Figure 6:
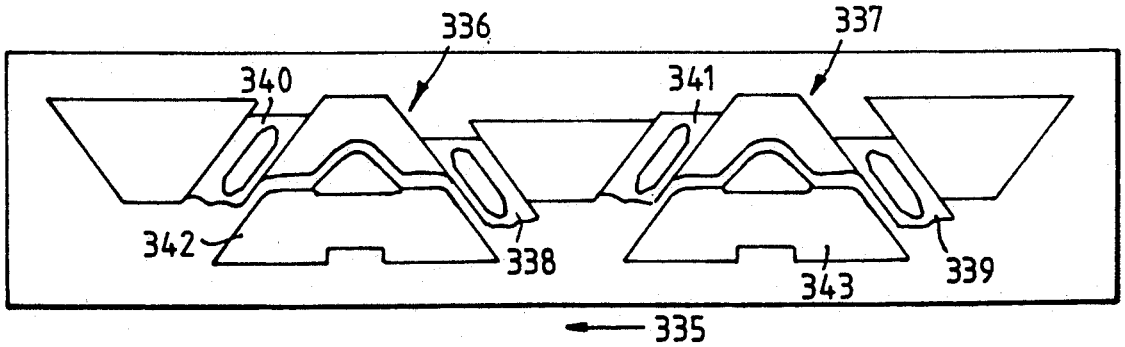
FIG. 6 is a view of a double system cam box travelling from right to left.
Figure 7:
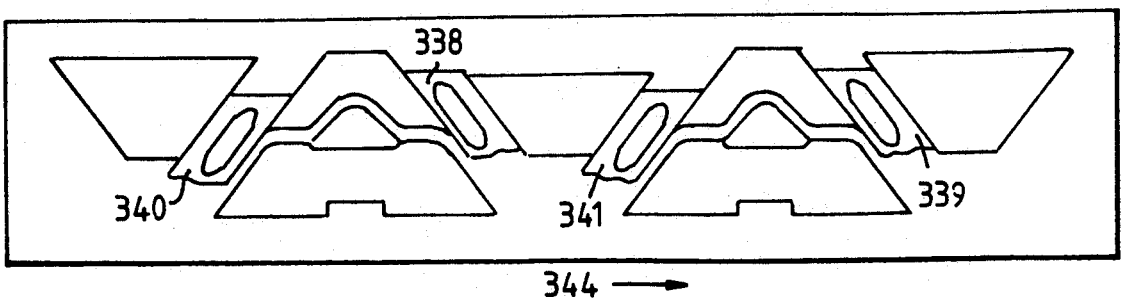
FIG. 7 is a view of a double system cam box travelling from left to right.

If two different yarns are used to produce the different structures in the adjacent regions, and the yarns may be of the same colour or a different colour, then the set up illustrated in FIGS. 6 and 7 may be used. Referring to FIG. 6, this shows a cam box moving in the direction of the arrow 335. The cam box has two camming systems generally indicated by 336 and 337. The lowering cams 338 and 339 are shown in their operative positions and the lowering cams 340 and 341 are shown in their retracted positions. Normally such a double cam system would be used to increase the production rate of the machine by knitting twice on the needles in each stroke in the direction of arrow 335. In such a case the lowering cams 338 and 339 would be in the same position so as to produce the same loop lengths for the stitches knitted on each cam system. In the case of the present invention, however, the position of the lowering cams 338 and 339 would not be the same but would be individually positioned so as to produce stitches with different loop lengths. The jacquard system for the knitting machine would then be operated such that the needles for one structure would be knitted on the cam system 336, their loop lengths being controlled by lowering cam 338, whereas the needles for the adjacent structure would be knitted by cam 337 and the loop lengths controlled by the position of lowering cam member 339. When the cam box is moved in the direction of arrow 335 the jacquard system would operate such that the needles for one structure would be raised into the path of the rising cam 342 but the needles for the adjacent structure would not be raised so that rising cam 343 would not engage the needles and therefore no knitting would take place on those needles. When the cam has moved on, the jacquard would then operate so that for the adjacent structure the needles are placed into operation so to be engaged by raising cam 343.

When the cam reverses its stroke to move in the direction of 344 as shown in FIG. 7 the lowering cams 338 and 339 are automatically lifted to move them out of position and the lowering cams 340 and 341 are moved down to their operative positions. Again, the position of the lowering cams 340 and 341 would be different and would control the loop lengths of different stitches in the different areas in exactly the same way as has been described above with reference to FIG. 6.

Figures 8A, 8B, 8C, 8D:
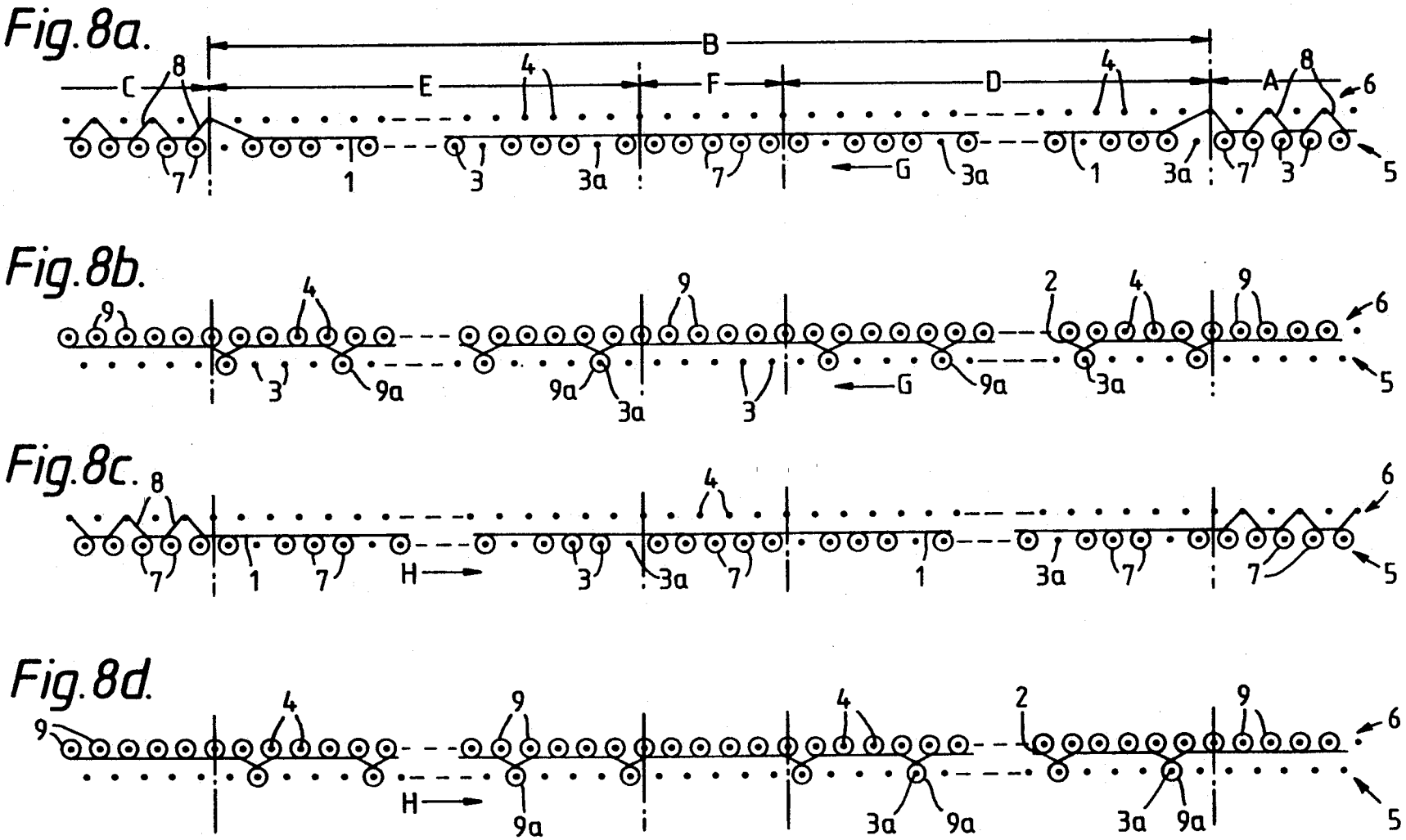
FIG. 8 is a series of diagrams (a)–(d) illustrating one embodiment of the method according to the invention.

Referring to FIG. 8, this illustrates the knitting of two complete courses of a fabric by the method according to the invention using a Dubied Jet 2F machine with 12 gauge needles. This machine is a flat V-bed machine of the type illustrated schematically in FIG. 1 provided with presser foot means to assist take-down of the knitted fabric. The machine can operate with a plurality of yarn supplies, each of which is associated with either system of the cam box. Each system comprises four stitch cams for actuating selected needles of the two needle beds, two of these cams being operative in one direction of traverse of the cam box along the needle beds, one for each needle bed, and the other two stitch cams being operative in the other direction of traverse of the cam box, also one for each needle bed. The four stitch cams of each cam system can be adjusted individually to select the loop length of the stitches produced by the needles actuated by the cams, and each stitch cam has an indicator which indicates, on a scale of 4 to 15, the setting to which the stitch cam has been adjusted. It will be appreciated, therefore, that the cam box for each needle bed would look like the cam box of FIG. 6 or 7.

In the example illustrated in FIG. 8, the fabric was knitted using two yarn supplies, both yarns being the same air-textured, continuous filament, polyester yarn having a count of 715 decitex. However, these yarns, which are designated 1 and 2 in FIG. 8, were of different colours, the yarn 1 being dark grey and the yarn 2 light grey.

In the diagrams (a)–(d) of FIG. 8, the numerals 3 and 4 designate needles of the front and rear needle beds 5 and 6, respectively, of the machine employed to knit a fabric consisting of side-by-side regions A, B and C. Regions A and B constitute the aforesaid first and second regions of the fabric and region C is a third region having the same structure as region A. Region B is divided into two smaller regions D and E by a further region F. The diagrams (a)–(d) of FIG. 8 show only some of the needles 3 and 4 employed to knit the regions A, C, D and E. In practice each of these regions would be knitted on many more needles than shown. For example, in the production of a piece of fabric to cover the base of an automobile seat, each of the regions A, C, D and E may be knitted on eighty or more needles in each of the beds 5 and 6. On the other hand, the region F is knitted on a much smaller number of needles. Although FIG. 8 shows six needles in each of the beds 5 and 6, a greater number of needles could be used.

FIG. 8(*a*) and 8(*b*) show the knitting of a first complete course of the fabric by traversing first the yarn carrier (not shown) associated with the dark grey yarn 1 and then the yarn carrier (not shown) associated with the light grey yarn 2 in the direction from right to left, as indicated by the arrows G. FIG. 8(*a*) shows the formation of a part-course of stitches 7 on needles 3 of the bed 5. In region A tuck stitches 8 are looped from needles 3 around every alternate needle 3 of the needle bed 6. In regions D and E the yarn 1 floats across every fourth needle 3*a*, whereas in region F stitches are formed on all the needles 3. In region C, tuck stitches 8 are again looped from the needles 3 around every alternate needle 4 of the bed 6, and stitches 9*a* on the needles 3*a* across which the yarn 1 floats in FIG. 8(*a*).

FIGS. 8(*c*) and 8(*d*) show the knitting of a second complete course of the fabric by traversing first the yarn carrier associated with the dark grey yarn 2 in the direction from left to right, as indicated by the arrows H. FIG. 8(*c*) shows the formation of a part-course of further stitches 7 of the yarn 1 on needles 3 of the needle bed 5. In this region of the fabric further tuck stitches 8 are looped from needles 3 around every alternate needle of the bed 6, but compared with FIG. 8(*a*) it will be seen that these tuck stitches 8 are displaced one needle to the right. In regions E and D the yarn 1 again floats across every fourth needle 3*a*, but compared with FIG. 8(*a*) the needles 3*a* are displaced one needle to the right in region E and one needle to the left in region D. In region F, stitches 7 are formed on all the needles 3. In region A, tuck stitches 8 are again looped from the needles 3 around every alternate needle 4 of the bed 6, but again it will be seen that, compared with FIG. 8(*a*) these tuck stitches 8 are displaced one needle to the right. FIG. 8(*d*) shows the formation of a part-course of stitches 9 of the yarn 2 on all the needles 4 of the bed 6 and stitches 9*a* on the needles 3*a* across which the yarn 1 floats in FIG. 8(*c*).

In the knitting of subsequent courses of the fabric, the procedures described above with reference to diagrams (a)–(d) are repeated in the regions A, F and C throughout the fabric. Thus, in the regions A, F and C, the course following that shown in FIGS. 8(*c*) and 8(*d*) is identical with that shown in FIGS. 8(*a*) and 8(*b*), and the course after that is identical with that shown in FIGS. 8(*c*) and 8(*d*). In the regions D and E, the procedures described above with reference to FIGS. 8(*a*) to 8(*d*) is identical with that shown in FIGS. 8(*a*) and 8(*b*), and the course after that is identical with that shown in FIGS. 8(*c*) and 8(*d*). In the regions D and E, the procedures described above with reference to FIGS. 8(*a*) to 8(*d*) are repeated, but in knitting each part-course of the dark grey yarn 1 the needles 3*a* across which the yarn 1 floats are progressively displaced one to the right, in region E and one to the left, in region D, and in each part-course of the light grey yarn the stitches 9*a* are progressively displaced one to the right, in region E and one to the left, in region D.

In one example of an upholstery fabric knitted, in the manner described above, with the previously mentioned light and dark grey yarns of 715 decitex, the stitch cam settings of the 12 gauge Dubied Jet 2F machine were individually set as follows:

| Yarn | Needle bed | Stitch cam setting |
|---|---|---|
| Dark grey | Front (5) | 7.5 |
| Dark grey | Rear (6) | 6.0 |
| Light grey | Front (5) | 7.0 |
| Light grey | Rear (6) | 7.5 |

so that the needles in region A and C were knitted with stitch cam settings of 6.0 and 7.5 and the needles in region B were knitted with stitch cam settings of 7.0 and 7.5.

The same stitch cam settings were employed for the cams which were operative in each of the directions of traverse along the needle beds. Examination of the finished fabric, after steam relaxation, revealed the following:

| Fabric region | Weight g/m$^2$ | Wales/cm | Courses/cm | Lengths (cm) of yarn fed per 100 stitches | |
|---|---|---|---|---|---|
| | | | | Yarn 1 | Yarn 2 |
| A and C | 440 | 6 | 8.5 | 75.8 | 52.8 |
| B | 390 | 5.75 | 8.0 | 47.4 | 68.8 |

Thus although the regions A and C were knitted with stitches of very different loop lengths (in terms of yarn feed per stitch) to the region B the total length of fabric knitted in each region was substantially the same.

The fabric did not exhibit any puckering along the wales where the region B joined the region A and C.

If the invention had not been used and the same loop length for each structure had been used, the relaxed fabric for regions A and C would have been 15% longer than the fabric in region B, and would have puckered at the interface. The exact lengths of each stitch loop length needed for two different adjacent structures can easily be determined by experiment, varying the cam settings to produce an even unpuckered fabric.

Figure 9:
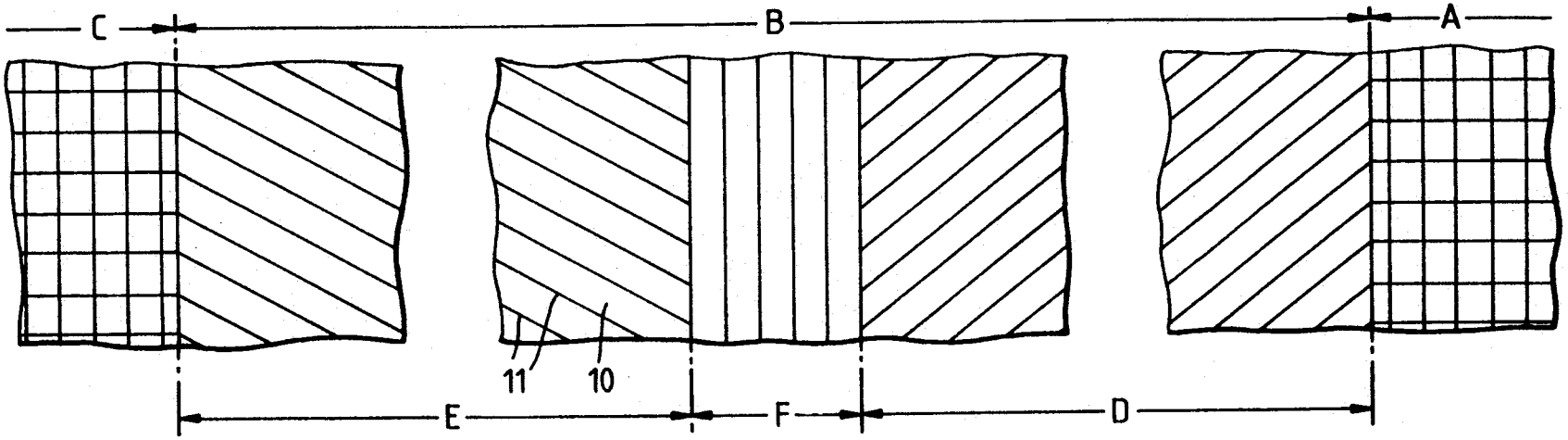
FIG. 9 is a schematic diagram of a piece of fabric knitted by the method illustrated in FIG. 8.

FIG. 9 is a schematic view of the fabric knitted in the manner described above with reference to FIG. 8. The central region B had an attractive herring bone appearance formed by the two jacquard regions D and E separated by the central region F which was a tube of single jersey structure. On the front of the fabric, the regions D and E had a dark grey background 10 with inclined lines 11 of light grey and the region F was dark grey. The regions A and C were dark grey on the front surface of the fabric and had a reticulated appearance.

If desired, the narrow region F may be omitted, so that the regions D and E are joined course-wise.

In a first modified form of the fabric knitted in the manner described above with reference to FIG. 8 the appearance of the regions A and C is changed, compared with the fabric of FIG. 9, by tucking the yarn 1 on the same needles 4 in the part-courses of FIGS. 8(*a*) and 8(*c*), and repeating this throughout the knitting of the fabric. The regions A and C will then have a corded appearance, extending in the wale-wise direction, instead of the reticulated appearance of FIG. 9. This first modified fabric may be knitted on the 12 gauge Dubied Jet 2F machine using the same stitch cam settings as set out above for the fabric produced by the method of FIG. 8.

In a second modified form of the fabric knitted in the manner described above with reference to FIG. 8, the appearance of the regions A and C is changed, compared with the fabric of FIG. 9, by tucking the yarn 1 on the same needles 4 in each of a first set of successive complete courses of the knitting, for example four successive complete courses, then, in a second immediately following set of successive courses, for example the next four successive complete courses, tucking the yarn 1 on needles 4 displaced one to the right compared with those employed in the knitting of the first set of complete courses. In the next set of successive courses tucking of the yarn 1 takes place on the same needles 4 as in the first set. Knitting proceeds in this way throughout the fabric, and the finished fabric has a combined reticulated and broken corded appearance in the regions A and C. This further modified fabric may be knitted on the 12 gauge Dubied Jet 2F machine using the same stitch cam settings as set out above for the fabric produced by the method of FIG. 8.

Figures 10A, 10B, 10C, 10D:
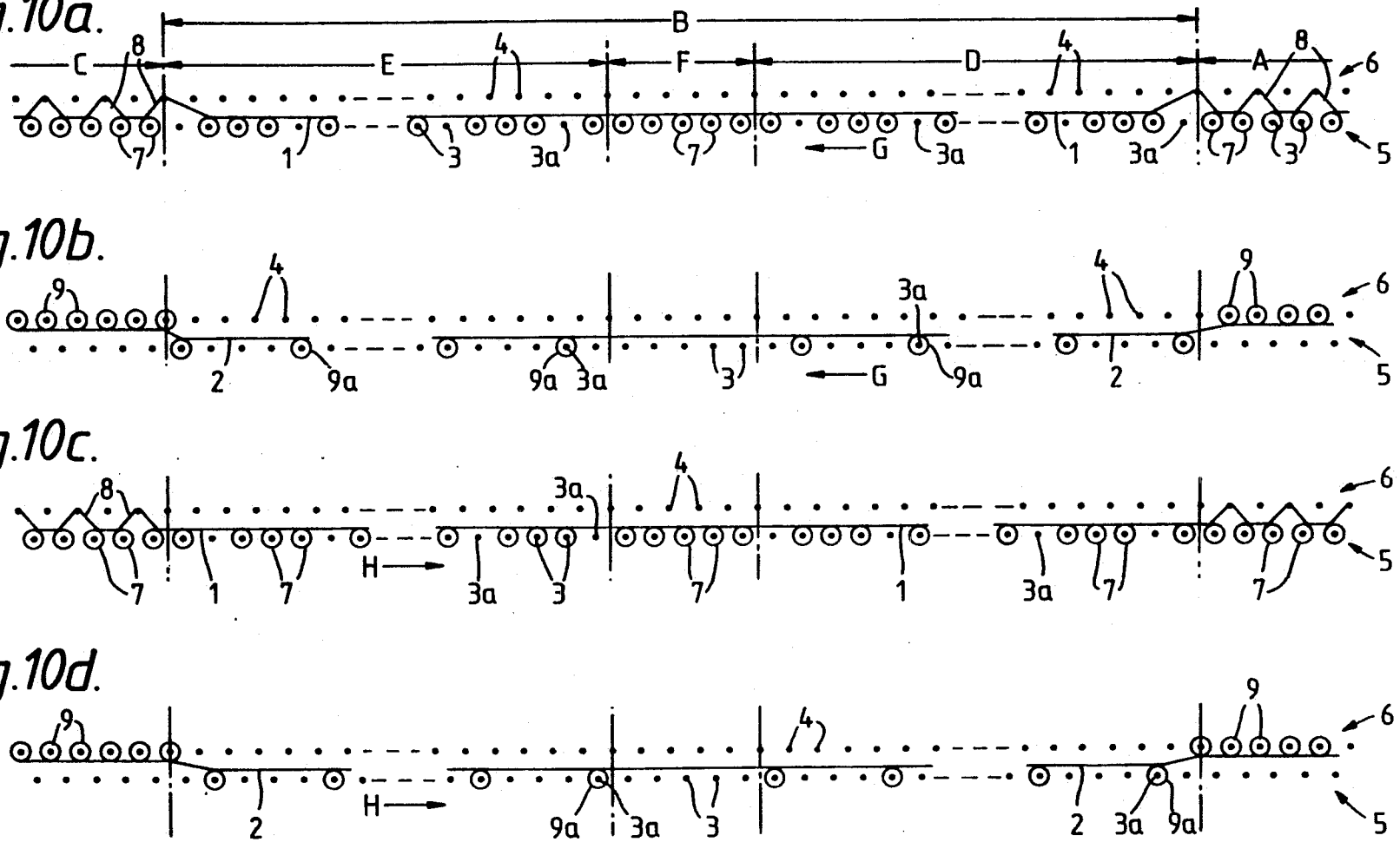
FIG. 10 is a series of diagrams (a)–(d) illustrating a second embodiment of the method according to the invention.

The fabric of FIG. 9 is of double thickness in all the regions A, B and C. In a yet further modified form of the fabric, the central region B may be of single thickness, and the method of knitting such a fabric is illustrated in FIG. 10. In this Figure, the part-courses illustrated in diagrams (a) and (c) are knitted with the dark grey yarn 1 in the same way as described with reference to FIGS. 8(*a*) and 8(*c*). The light grey yarn 2, however, is knitted only on the needles 3*a* in the regions D and E and on the needles 4 in the regions A and C. In the regions D, E and F the yarn 2 floats at the back of the fabric between adjacent needles 3*a*. This results in the formation of a single jersey jacquard fabric in the regions D and E separated by a few courses of single jersey fabric in the region F. This modified fabric wail have substantially the same appearance as the fabric of FIG. 9. The knitting of this fabric will not require any substantial difference in the stitch cam settings of the Dubied Jet 2F machine, compared with knitting the fabric of FIG. 9.

The regions A, B and C of each of the fabrics described above with reference to the drawings were tested as regards their resistance to snagging using the Mace Snag Test described in B S Handbook 11: 1974. In this test, a tube of fabric is positioned over a rubber-covered cylindrical drum 203 mm long and 83 mm in diameter and carrying a tubular woven wool felt of 3.2 mm thickness. The drum, with its axis horizontal, is made to rotate at 60 r.p.m. A phosphor bronze sphere (the mace) 31.75 mm in diameter and carrying eleven equi-spaced tungsten-carbide points each projecting 9.5 mm is suspended above the drum by a chain with points of the mace resting on the fabric specimen. In each test the drum is rotated for a period of 10 minutes, during which it performs a total of 600 revolutions. Two specimens are normally run, with the fabric courses parallel to the axis of rotation of the drum in the first specimen, tending to produce snagging in the wale direction, and at right angles to this direction in the second specimen, tending to produce snagging in the course direction. The action of the mace is to tend to pull yarns or groups of filaments out of the fabric to form distorted loops on the surface. The performance of the fabric in relation to the density of snags produced is assessed by mounting the tested specimens individually in a viewing cabinet and comparing them with a set of nine photographic standards, ranging from Standard 5 (no snagging) to Standard 1 (severe snagging), in half standard steps. A result between two adjacent photographic standards is given the more severe rating.

Specimens of regions A, B and C of each of the fabrics produced by the methods described above with reference to the drawings were subjected to the test procedure just described and each specimen registered Standard 4, showing that each of the fabric regions had a resistance to snagging which is at least as good as that of a conventional woven fabric used for covering automobile seats.

In addition, the abrasion characteristics of the regions A, B and C of each of the fabrics produced by the methods described above with reference to the drawings were tested by the Taper Abrasion Test described in ASTM D 3884 in which specimens of each fabric region were subjected to 1000 cycles on the Taper Abrader using CS-10 wheels and 1000 g weights. In each case the fabric specimens showed no obvious defects at the end of the tests, indicating that each fabric had a sufficiently high abrasion resistance for employment in an automobile seat cover.

A yet further advantage of the present invention is the ability to provide an island or panel of one structure in a sea or matrix of a different structure. This enables an island of one texture or feel or appearance (either with or without a colour change) to appear in a background of a different texture feel or appearance. Although it is well known to produce islands of one colour inside a further colour this has conventionally been done by the mere substitution of one colour yarn for another whilst keeping the structure the same.

Figure 11:
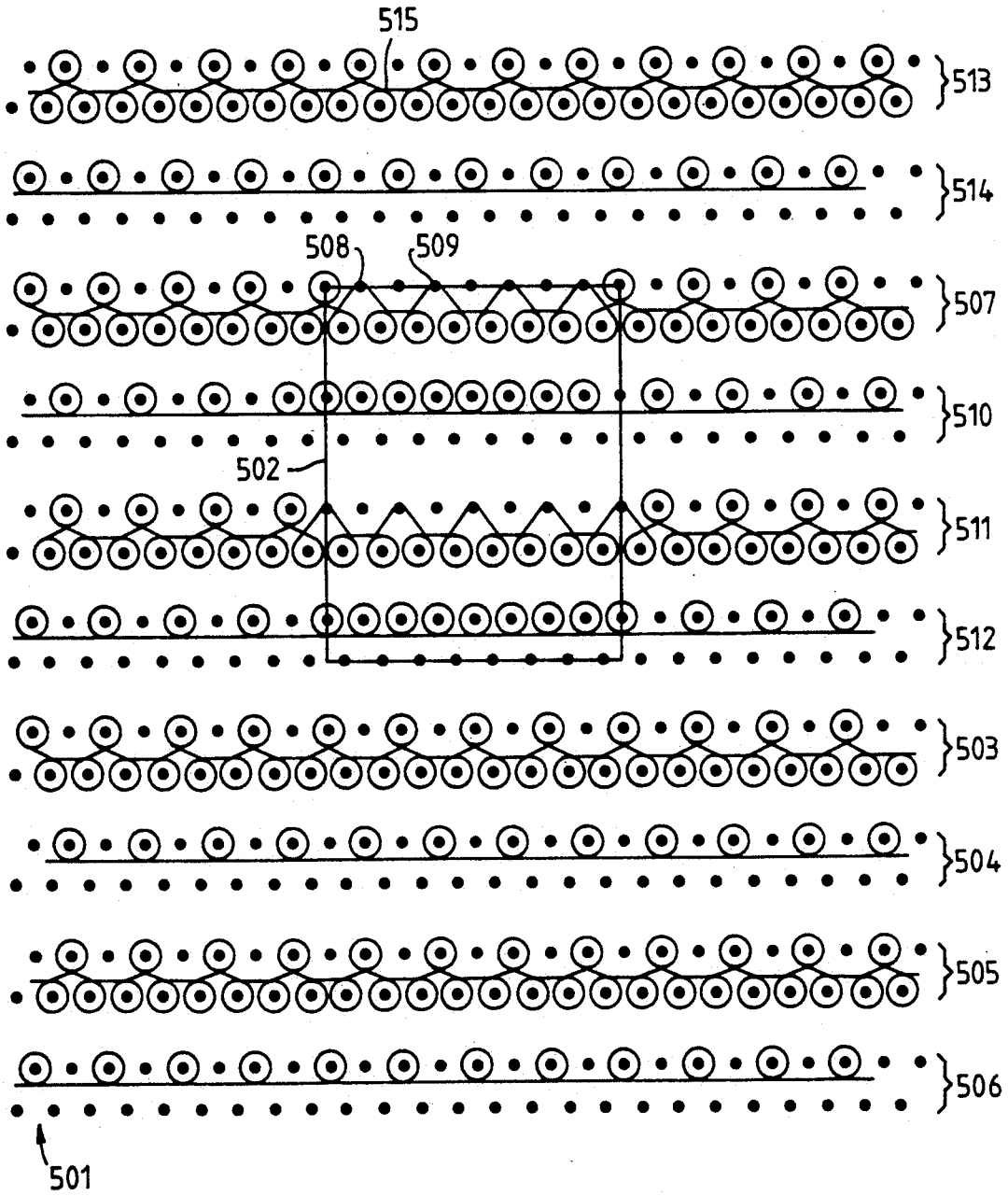
FIG. 11 is a diagram of an island fabric structure.

In the case of apparel, where the stitch density is relatively low, slight variations in structure may be permissible without any significant deterioration in the fabric by way of puckering between adjacent regions. However, in the case of upholstery fabric differences in structure become very significant in terms of puckering between adjacent regions and hence the invention by the control of loop length in the different regions enables a panel such as a decorative panel, a name panel or other identifying feature to appear in a background matrix of a different structure. Referring to FIG. 11 this shows a stitch diagram which permits the manufacture of a fabric having an island of one structure in a matrix of a further structure. In FIG. 11 there is shown a sea structure generally indicated by 501 containing an island structure within the rectangle 502. The sea structure is a four course repeat structure commonly referred to as a "bird's eye-backed" structure.

The bird's eye-backed structure may be most easily understood with reference to the four courses of knitting illustrated below the rectangle 502. In the course 503 there is knitted a rib type structure in which every alternate needle on the rear bed is knitted and every needle on the front bed is knitted. In the next row, 504, the rear bed only is knitted upon with the knitting taking place on the alternate needles not previously knitted upon in row 503.

Row 505 corresponds to row 503 but translated one needle to the right. Similarly row 506 corresponds to row 504 but again translated by one needle to the right.

Considering the four courses 503 to 506 as a whole it can be seen that there is clearly a balance of the fabric from left to right as the fabric structure is the same across all of the needles. There is also an even balance between the front and rear of the beds as the same number of stitches are knitted on each bed in total and after four courses the same amount of yarn crosses over from the front beds to the rear beds in a uniform way thus providing a complete balance between front and rear needle beds. This total balance means that the bird's eye-backed structure of the sea of the fabric will grow at an even rate front to back and from side to side.

When considering the structure within the island however it can be seen that the structure is again a four course repeat but in this case the knitted structure is different. In the case of the row or course 507 within the island 502 there is knitting on all of the front needles but the alternate needles on the rear bed only form tuck stitches as at 508, 509. In the next row 510, stitches are formed on all needles of the rear bed but no stitches are formed on the front bed. Row 511 corresponds to row 507 but displaced by one needle to the right and row 512 corresponds to row 510 again displaced by one needle to the right.

The stitch diagrams illustrated effectively represent a view looking down onto the needle bed with the dots corresponding to the needles and the loops and lines corresponding to the yarn. It is important to note that the stitch diagrams show the loops and yarn as they are held on the needles. When knitting proceeds the loops are liberated from the needles as new loops to form new stitches on the next subsequent row. With a rib type structure as shown in row 513 the yarn such as the portion of yarn illustrated at 515 which passes from the front bed to the rear bed is free to move and in practice the stitches in a rib structure will move closer together from front to rear and the fabric will become longer in the direction of the pull-off. With a structure as shown in course 514 there is little growth in the length of the fabric after the next row of stitches has been formed. Because there is little yarn passing from the front bed to the rear bed, the growth in length of the fabric in the pull-off direction is little more than the mere thickness of the yarn itself. Thus the growth or length of the fabric in the wale-wise direction in a bird's eye-backed type structure is strongly dictated by the increase in length resulting from the rib type structure in which yarn crosses from the front bed to the rear bed. Thus the growth in length in a wale-wise direction will effectively be dictated by the structure shown in rows 505, 503 and 513. Of course the structure outside the box or island 502 in rows 511 and 507 will grow at the same rate as row 503, 505 and 513.

Within the island 502, however, the linear growth of the fabric in a wale-wise direction will effectively depend upon the length of the tuck stitches such as stitches 508 and 509. The linear growth of rows 512 and 510 will be very similar both within and outside the island or box 502 although the tighter structure within the island or box in rows 510 and 512 will lead to slightly less growth than the growth of fabric in a linear direction in rows 510 and 512 outside the box.

To obtain the same linear growth of fabric within the box as compared to outside the box therefore it will be necessary to control the stitch length of the tuck stitches 508 and 509 in rows 507 and 511 as it is the length of these stitches which will govern the growth in size of the loops on the front bed during pull down and relaxation of the fabric thus enabling the fabric structure to be balanced both inside and outside the island box 502.

Figure 12:
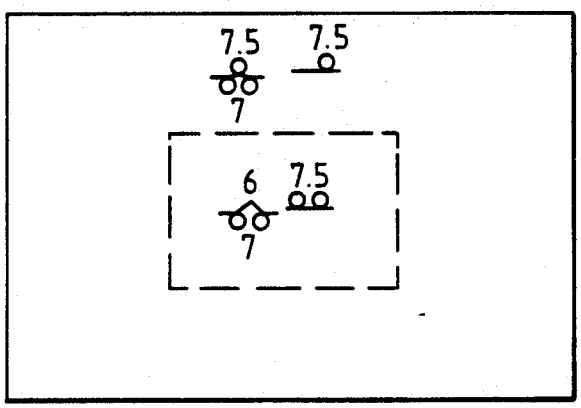
FIG. 12 is a diagram of cam settings for producing the structure of FIG. 11.

Typically the cam settings which would be required for the fabric inside and outside the box will be as follows:

on the outside of the box i.e. in the 'sea' of knitting the stitch cam settings would be 7.5 and 7, as shown in FIG. 12 and in the island the stitch cam settings would be 6, 7.5 and 7.

This will result in a growth in fabric linear length utilising 715 decitex air textured polyester yarn knitted on a twelve gauge machine of 10.2 courses per centimeter. In the event of the use of a common cam surface with common loop length formation between the region inside and outside the box there would be a tendency in the relaxed state for 26 courses of birds eye back structure forming the sea to occupy 2.5 cm in height compared to the same 26 cm of the structure within the island 502 occupying 2.9 cm in vertical height. Thus in the absence of the incorporation of the present invention into the structure the island would be puckered within the sea but by the use of the present invention the island can be in a stress free smooth condition within the sea.

Figure 13:
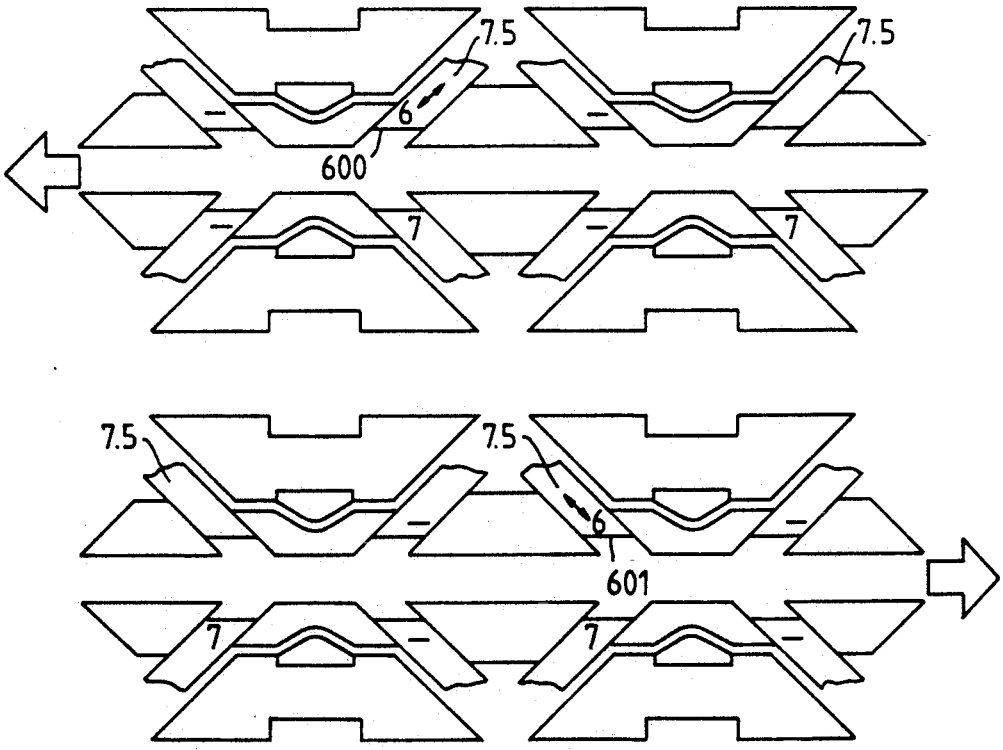
FIG. 13 is a cam box showing adjustable cams.

Preferably the cam system illustrated in FIG. 13 is used to knit the structure shown in FIG. 11, wherein the cams 600 and 601 are adjustable during movement of the cam box. In FIG. 13 the numbers 6, 7 and 7.5 indicate the stitch cam settings referred to above in connection with FIG. 12.

The ability to knit side-by-side structures which would otherwise be unbalanced permits the production of a wide range of different effects in the upholstered structure. A particularly useful series of effects can be obtained by the incorporation of tuck stitches into the knitted structure.

FIGS. 14 to 21 illustrate alternative forms of knitted upholstery structures incorporating tuck stitches which may be used in side-by-side relationship with a bird's eye-backed structure or which may be used alone over the entire knitted upholstery structure. The use of the tuck stitches in the upholstered structure in which there is a very high density of yarn in the structure gives the ability to produce extremely interesting visual and technical effects in the fabric. Because the tuck stitches provide bulk without significantly increasing the linear growth of the structure as knitted, a three dimensional type of effect can be provided by the incorporation of such tuck stitches.

Figure 14:
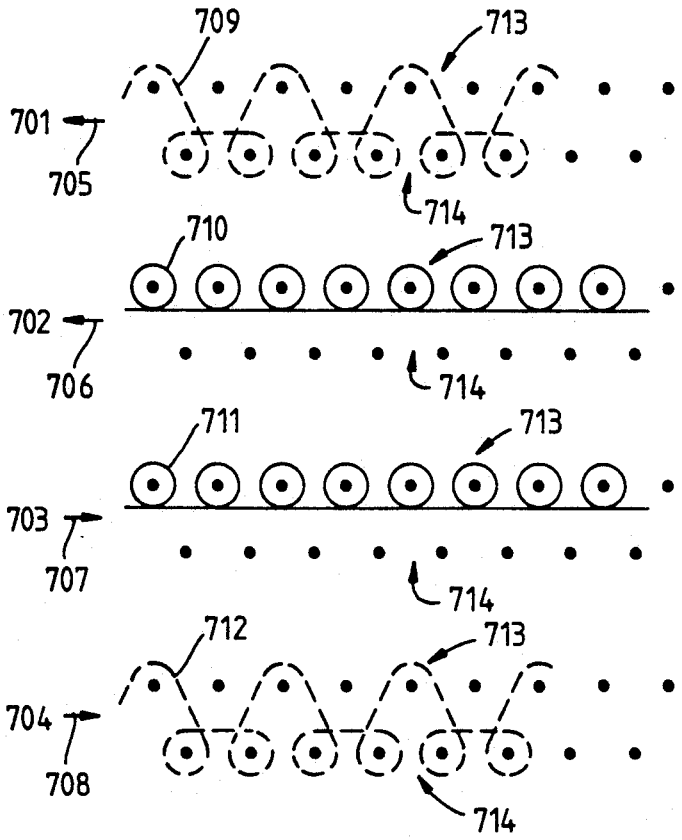
FIG. 14 is a stitch diagram of a tuck rib structure.
Figure 15:
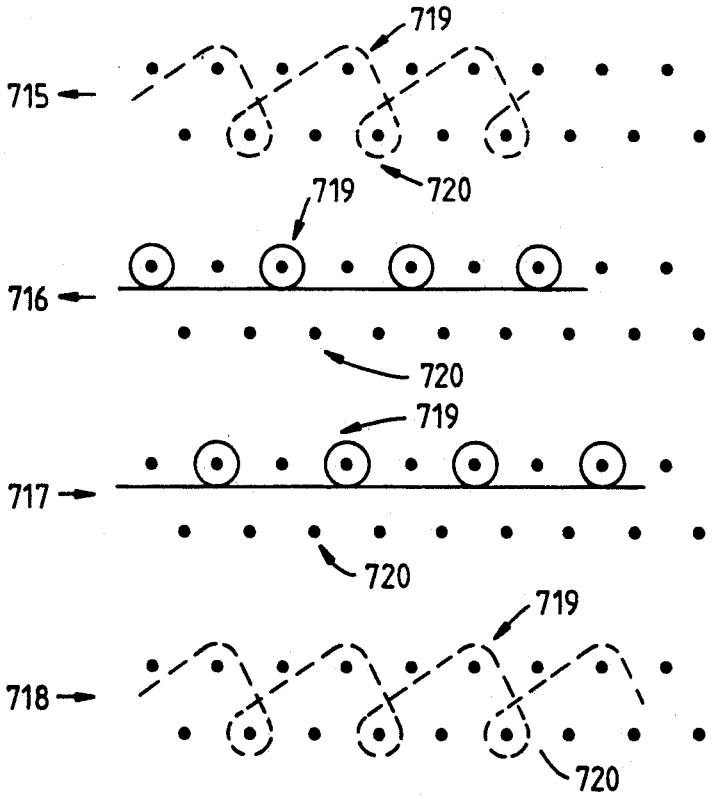
FIG. 15 is a stitch diagram of a bullet structure with tuck stitches.

FIG. 14 illustrates a four course repeat whereby a tuck rib structure may be produced. The structure knitted in accordance with FIG. 14 is preferably knitted using a double system cam box so that courses 701 and 702 are knitted sequentially as the cam box moves in the direction of arrows 705,706 i.e. from right to left as shown in FIG. 14. The first coloured yarn 709 knits on all of the front needles on bed 714 and is tucked on alternate needles on rear bed 713. Immediately after yarn 709 has knitted and during the same passage, second yarn 710 is knitted on all of the rear needles in the rear bed 713 but is not knitted on any of the front needles in bed 714.

On the return passage of the cam box in the direction of arrows 707,708 i.e. from left to right in course 703 yarn 711 knits on all the rear needles in rear bed 713 but is not knitted on the front needles in front bed 714. Immediately afterwards the second yarn 712 is knitted on all of the front needles in bed 714 but is tucked on the alternate needles in the rear bed 713. It will be seen that the tuck stitches in course 704 are on the alternate needles of the rear bed 713 to those employed in course 701. This knitting procedure will produce a tuck rib type of structure, which may be used as the panel or the surroundings or in its entirety in the entire knitted structure.

Referring to FIG. 15, this again shows a four course repeat structure having four courses 715, 716, 717 and 718. The knitting sequence is effectively identical to that illustrated in FIG. 14 and the structure is knitted using a double system cam box in exactly the same way as the structure of FIG. 14. In this case, however, the course 715 has alternate tuck stitches on a rear bed 719 and alternate knitted stitches on a front bed 720. Course 715 is knitted with one yarn and the same yarn is used to knit course 718. Sequentially with course 715 the second yarn is knitted as in course 716 on alternate rear needles only. On the reverse passage of the cam box, the same yarn is knitted on alternate needles on the rear bed only but on the needles not knitted on in course 716. Finally, in course 718 the first yarn is tucked on alternate needles on the rear bed and is knitted on alternate needles on the front bed. It can be seen that course 715 is identical to course 718.

This type of knitting sequence produces a bullet-type structure.

Figure 16:
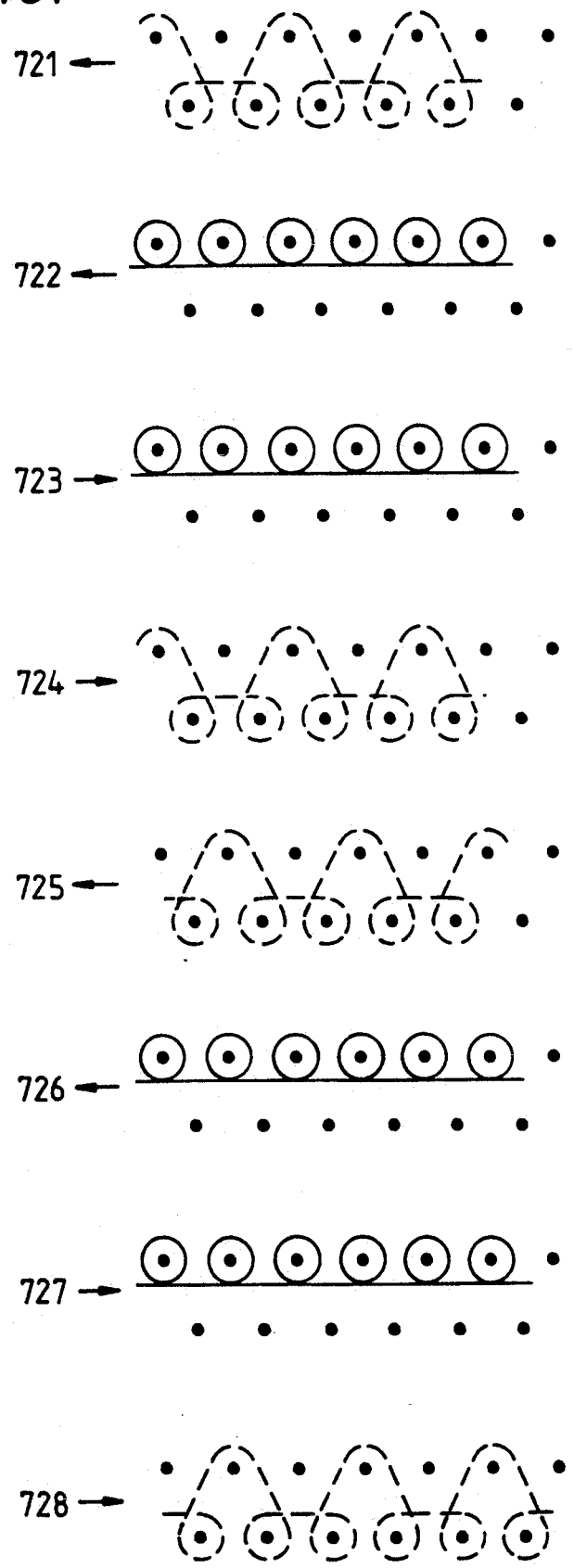
FIG. 16 is a stitch diagram of a tuck dimple structure.

FIG. 16 illustrates an eight course repeat structure which produces a tuck dimple system. Again a double cam box system is used so that courses 721 and 722 are knitted in the same passage sequentially as are courses 723 and 724, followed by courses 725 and 726, and courses 727 and 728. As previously, the arrows indicate the direction of movement of the cam box. The structure illustrated in FIG. 16 will produce a tuck dimple type of effect with the appearance of dimples in the fabric. The structure illustrated in FIGS. 14 and 15 may be used, as is the structure of FIG. 14 as the central panel, as a region or may extend over substantially the whole or the whole of the upholstered structure.

Figure 17:
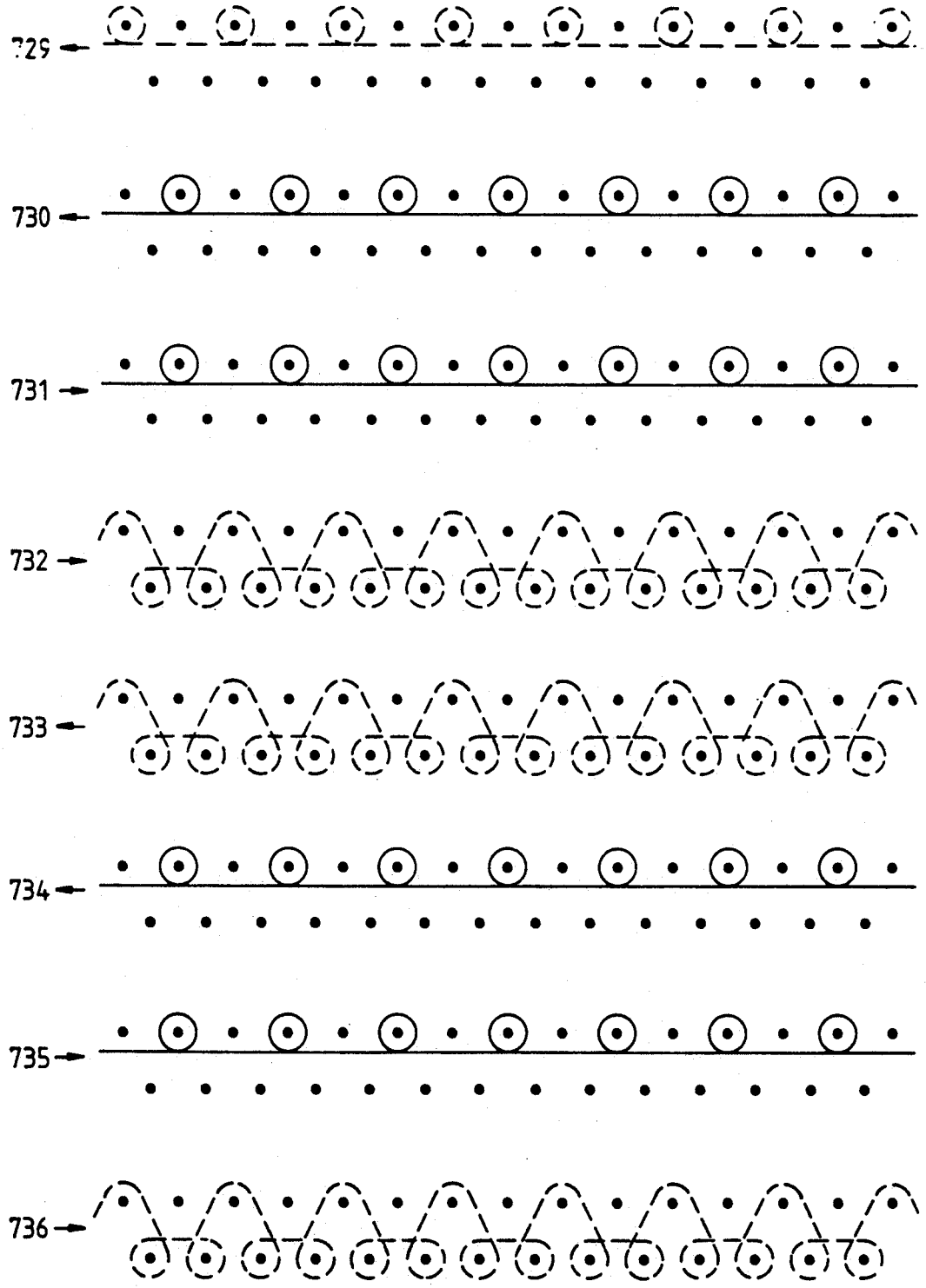
FIG. 17 is a stitch diagram of a dash tuck structure.

The eight course repeat structure illustrated in FIG. 17 is very similar to that of FIG. 16 except that it will produce a dash tuck structure when knitted over a significant area. Again, courses 729 and 730 are knitted sequentially in the first passage of the cam box from right to left, as are courses 731 and 732 in the passage of the cam box from left to right. Courses 733 and 734 are knitted on the second passage of the cam box from right to left and courses 735 and 736 are knitted in the second passage of the cam box from left to right. The structure produced by FIG. 17 is, as mentioned above, a dash tuck structure.

Figure 18:
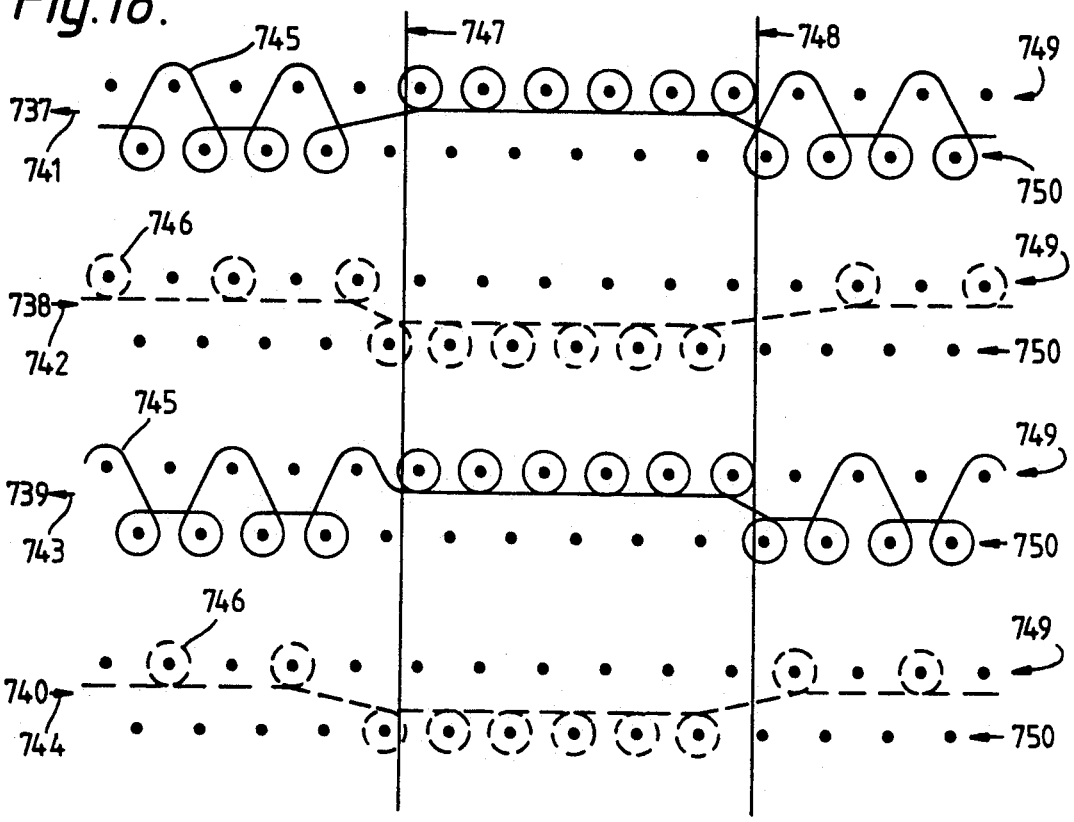
FIG. 18 is a stitch diagram of a deep pile structure.

FIG. 18 illustrates a deep piled structure produced using a single cam box system so that course 737 is knitted when the cam box moves from right to left as shown by arrow 741. The yarn 745 is knitted with one structure to the left of line 747 and with the same structure to the right of line 748. It is, however, knitted with a different structure between lines 747 and 748. This is also true in general terms of yarn 746 in course 738 and the same yarns in courses 739 and 740.

In course 737 the yarn 745, which is the first yarn, is tucked on alternate stitches on a rear bed 749 and is knitted on all of the front bed needles in a front bed 750. In the region between lines 747 and 748, however, the yarn 745 is knitted only on the rear needles in the rear bed 749. The yarn 745 is not knitted on the needles in the front bed 750 between lines 747 and 748. To the right of line 748 the yarn 745 is knitted in exactly the same structure as is knitted to the left of line 747.

In the second passage of the cam box from left to right as illustrated by arrow 742, the second yarn 746 is knitted on alternate rear needles in bed 749 in the region to the left of line 747. Between lines 747 and 748 the yarn 746 is knitted only on the needles on the front bed 750. In the region between line 747 and 748 the yarn is not knitted on the needles of the rear bed 749. To the right of line 748 the structure knitted is the same as is knitted to the left of line 747.

In course 739 the yarn 745 is knitted with the cam box moving to the left as illustrated by arrow 743 and knits essentially the same structure as in course 737 but displaced by one needle to the right. Thus, again in course 739 the yarn 745 is tucked on the rear needles in the rear bed 749 to the left of line 747 and to the right of line 748 and knits on all of the needles in rear bed 749 whereas in course 740 between lines 747 and 748 the yarn 746 is knitted on the needles of the front bed 750 only.

Finally, in course 740 a structure similar to course 738 is knitted but again with the knitting being displaced by one needle to the left in this case.

The effect of knitting this structure is to produce a tubular jersey region between lines 747 and 748 which is much thinner than the structure produced to the left of line 747 and to the right of line 748. This, therefore, produces a depression in an otherwise three dimensional fabric and gives the effect of a fabric having a recessed groove in it.

Figure 19:
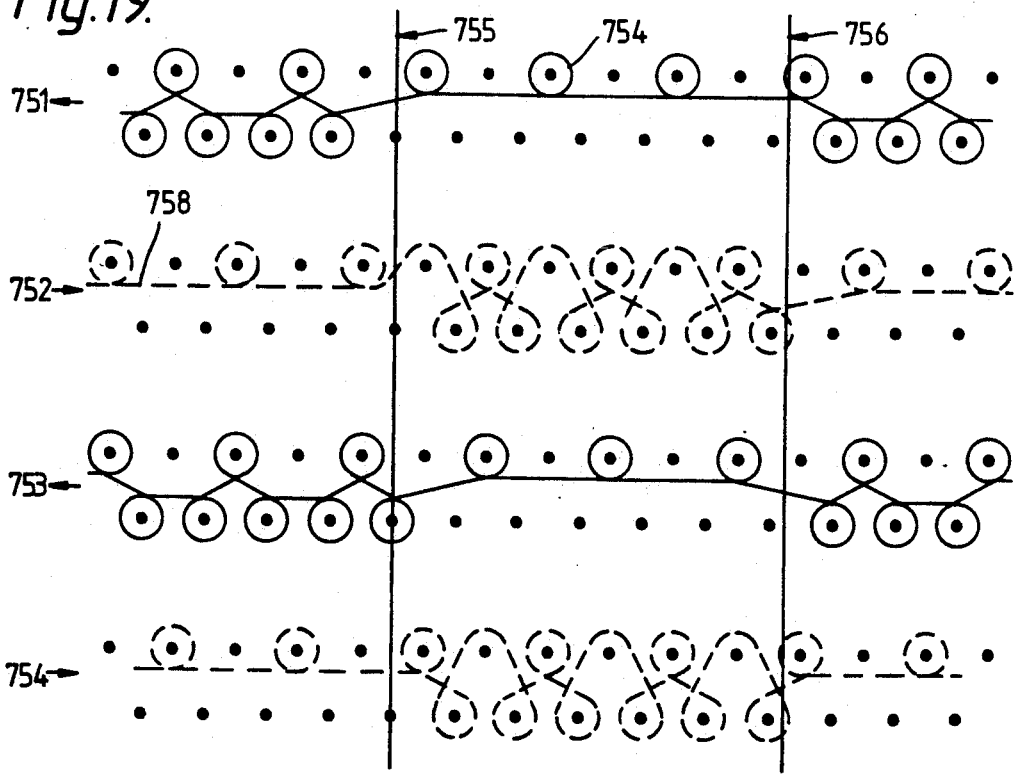
FIG. 19 is a stitch diagram of a raised effect structure.

In the structure illustrated in FIG. 19, effectively, the reverse of the structure of FIG. 17 is produced. Again, there is produced a four course repeat having the four courses 751 to 754. To the left of line 755 and to the right of line 756 there is a conventional bird's eye-backed structure. However, between lines 755 and line 756 in course 751 a first yarn 757 is knitted only on alternate rear needles. In course 752 a yarn 758 is knitted on all of the front needles and is alternately tucked and knitted on the rear needles. The yarn 758 is tucked on those needles on which the yarn 757 has been knitted in course 751. Course 753 is effectively the same as course 751 but displaced by one stitch to the right as is course 754 compared to course 752.

The effect of this is to produce in the region between line 755 and line 756 a raised region in comparison with the bird's eye-backed structure produced to the left of line 755 and to the right of line 756. Obviously, line 755 and line 756 need not be straight. Similarly lines 747 and 748 in FIG. 18 need not be straight.

The structure shown in FIG. 20 is again an eight course repeat involving courses 760 to 767 inclusive. This structure is knitted in much the same way as the structure illustrated in FIG. 15 except that in course 760 a first yarn 768 is knitted on all of the front needles and is tucked on alternate rear needles. In courses 761 and 762 a second yarn 769 is knitted on all of the rear needles in courses 761 and 762. In courses 763 and 764 the first yarn 768 is again knitted on all of the front needles and is tucked on alternate needles of the rear bed. As can be clearly seen in the case of courses 763 and 764 the yarn is tucked on the rear bed in one course on one set of alternate needles and on the next course on the other set of alternate needles. Again, in courses 765 and 766, yarn 769 is knitted on all of the rear needles only.

Finally in course 767 the yarn is tucked on alternate rear needles and knitted on all front needles. This produces a grid structure.

In the structure illustrated in FIG. 21 there is again produced an eight course repeat on courses 770 to 777 inclusive. Course 770 to 772 are very similar to courses 760 to 762 in FIG. 20 in that in course 770 a first yarn 778 is tucked on alternate rear needles and knitted on all front needles. A second yarn 779 is knitted on all rear needles only in courses 771 and 772. In course 773 the first yarn 778 is knitted on all front needles and knitted on the same needles on the rear bed as were tucked in course 770. The second part of the structure illustrated in courses 774 to 777 is essentially the same as courses 770 to 773 except they are displaced by one stitch to the right. Thus, in course 774 the yarn 778 is tucked on alternate rear needles and knitted on all front needles. The yarn is tucked on the needles of the rear bed in course 774 which were left empty in course 770. In courses 775 and 776 yarn 779 is knitted on all rear needles. Finally in course 777 the yarn 778 is knitted on all of the needles of the front bed and is knitted on alternate needles on the rear bed, the same needles as were tucked in course 774.

Figure 20:
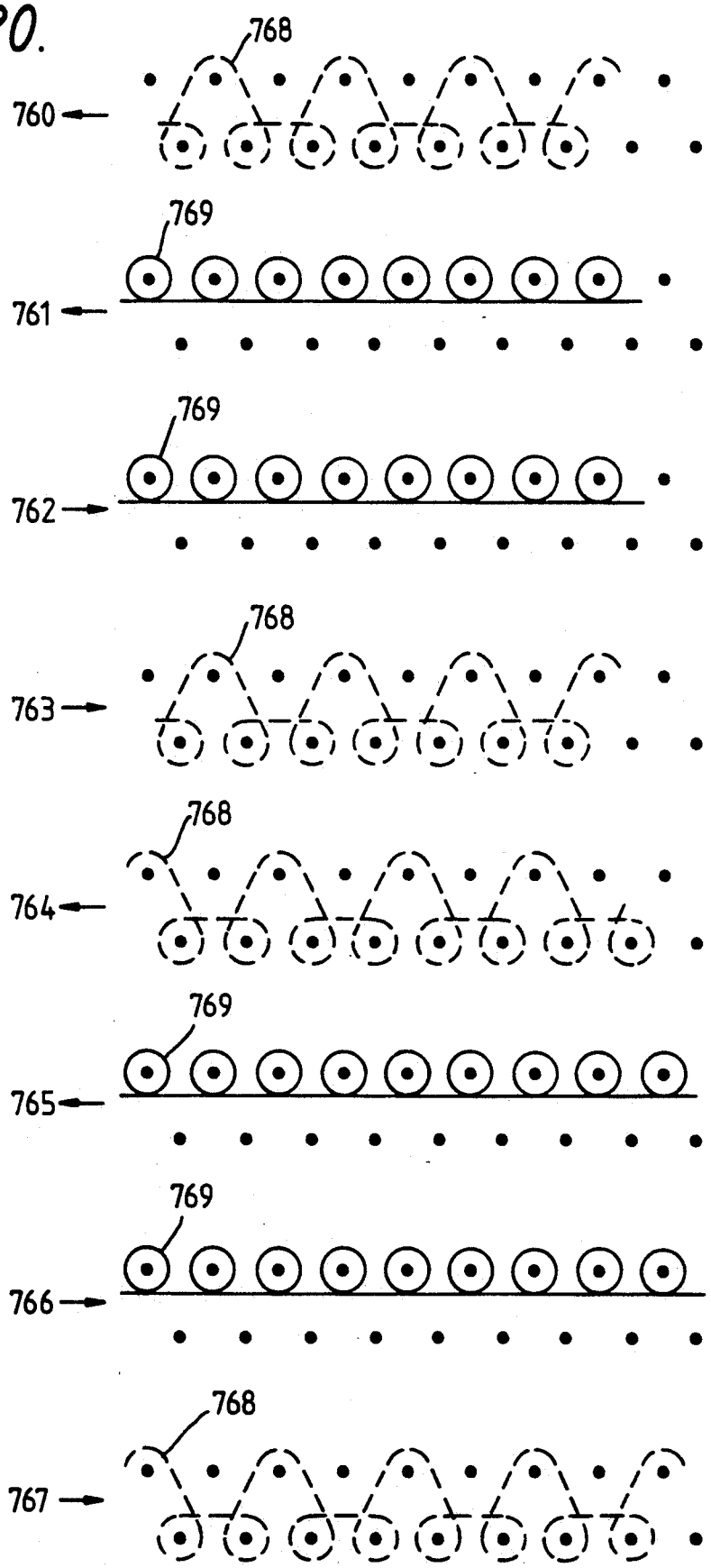
FIG. 20 is a stitch diagram of a grid structure.
Figure 21:
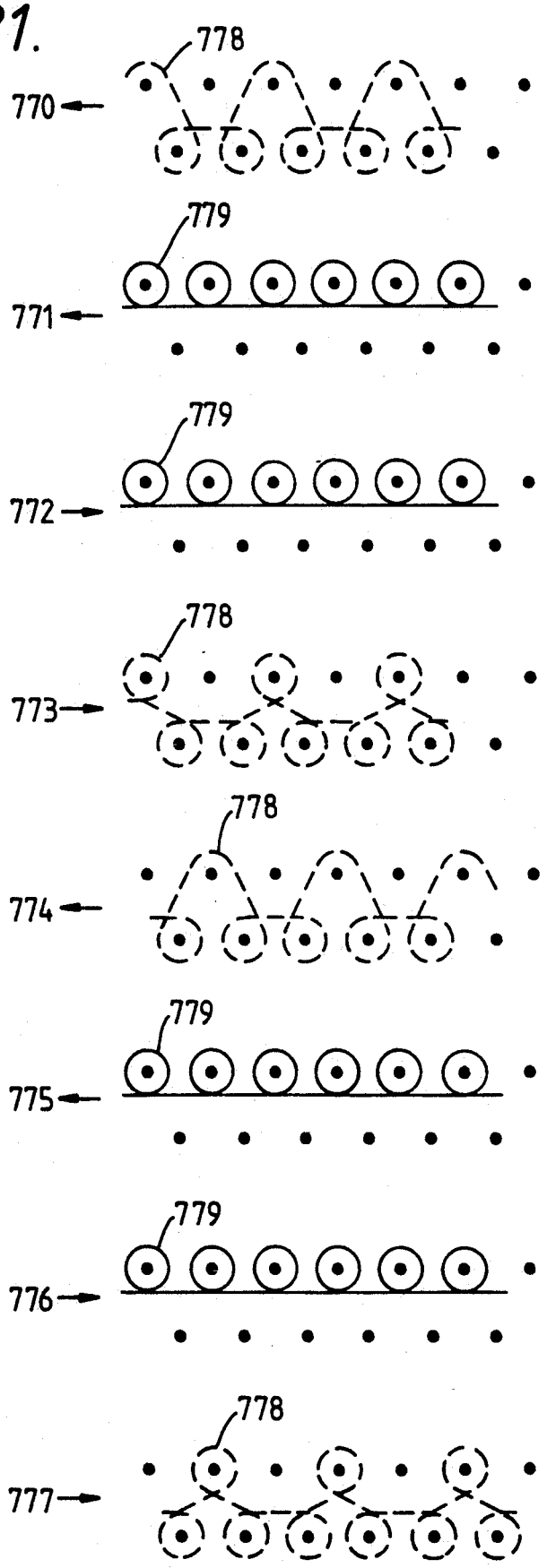
FIG. 21 is a stitch diagram of a star tuck structure

The structure illustrated in FIG. 21 produces a star tuck design and, as is the case of the structure illustrated in FIG. 20, may be used as an island or a panel in an alternative structure, or as a complete strip in an alternative structure or may be used on its own over substantially the whole of a knitted upholstery structure.

Figure 22:
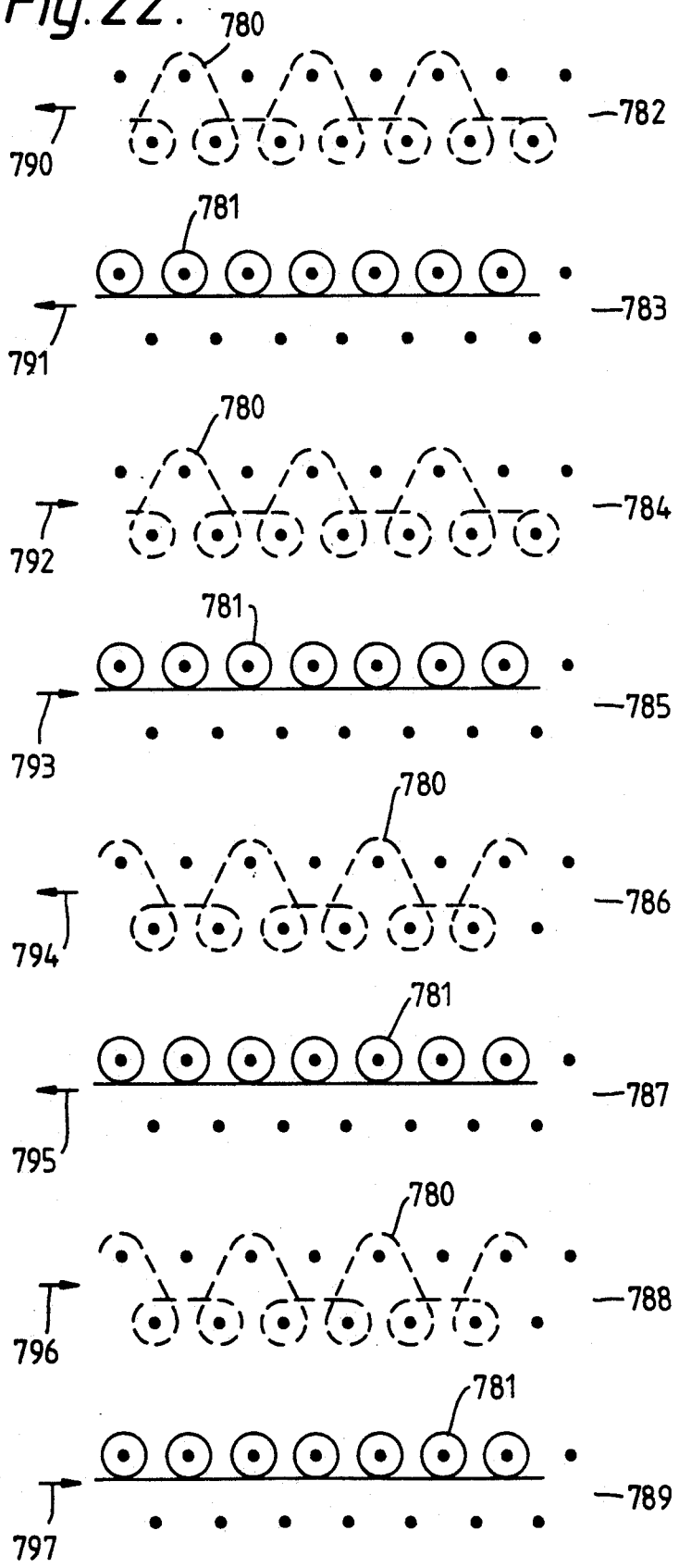
FIG. 22 is an alternative stitch diagram to produce a tuck dimple structure.
Figure 23:
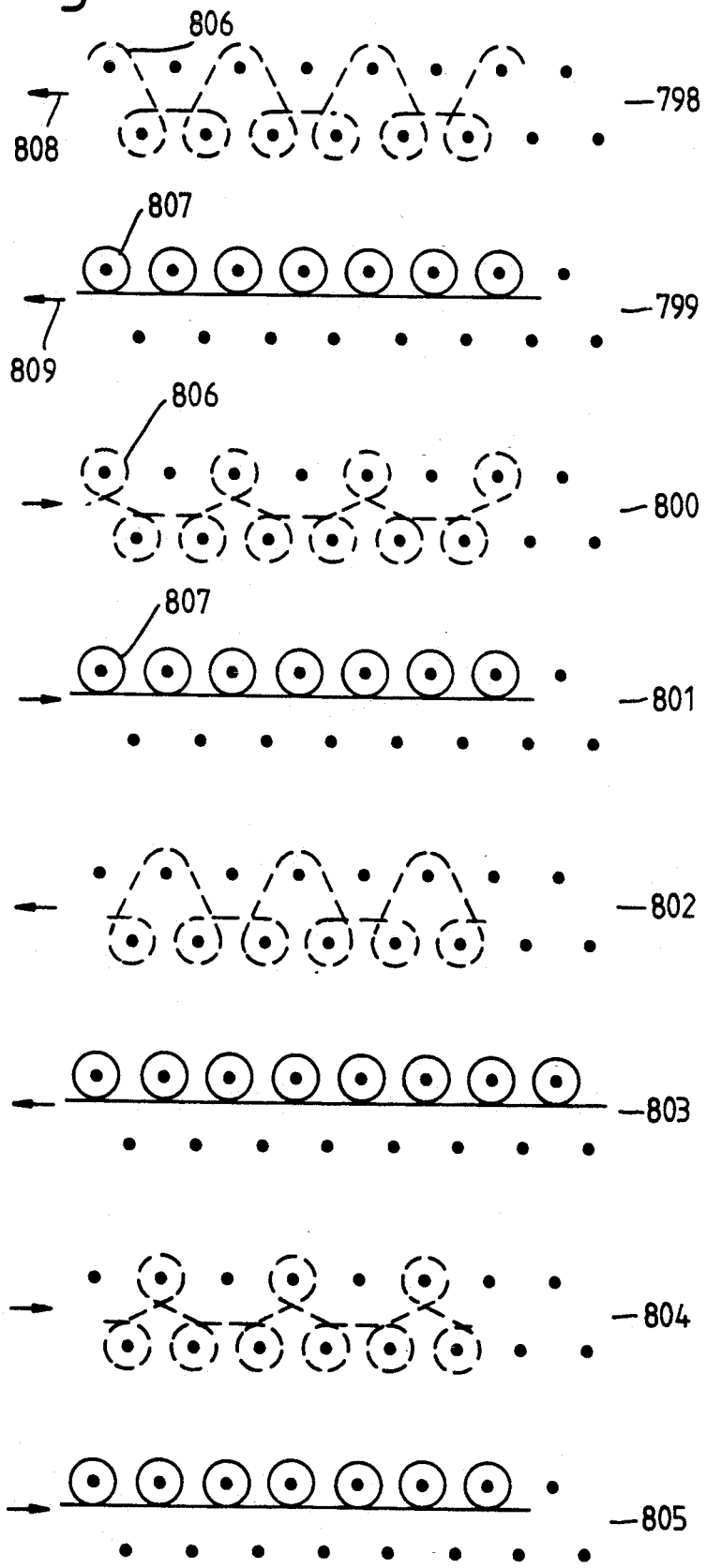
FIG. 23 is an alternative stitch diagram to produce a star tuck structure.

Illustrated in FIGS. 22 and 23 are alternative methods for producing tuck dimple and star tuck structures, respectively.

Referring to FIG. 22 this shows a stitch diagram in which the first yarn is shown by a dotted line 780 and the second yarn is shown by a solid line 781. The first two courses 782 and 783 are knitted with the cam box moving in the direction of arrows 790 and 791. The course 782 is knitted with the yarn 780 being knitted on all of the needles on the front bed but being tucked on alternate needles on the rear bed. During the same passage of the cam box, yarn 781 is immediately knitted sequentially again with the cam box moving in the direction of arrow 791, and in this case is knitted on all of the needles of the rear bed.

When the cam box has reached the end of its travel and reverses, so as to move in the direction of arrows 792 and 793, the yarn carriers carrying yarns 780 and 781 are first released by the cam box and then picked up so that the first yarn 780 is then knitted in course 784. Sequentially and immediately afterwards the second yarn 781 is then knitted on course 785. By comparison, the tuck dimple structure illustrated and referred to previously had the sequence of knitting firstly the first yarn, then on the second course the second yarn, then on the third course the second yarn again and then on the fourth course the first yarn. Such a sequence does not involve a cross-over of the threads at the end of the knitted course but does mean that the first yarn is initially knitted in the leading position and is then knitted in the trailing position. With the system illustrated in FIG. 22, the first yarn 780 is always knitted in the leading position and the second yarn 781 is always knitted in the trailing position. It can be seen from FIG. 22 that the first yarn 780 in course 784 is knitted on the same needles as in course 782. Similarly, in course 785 the second yarn 781 is knitted on all of the rear needles as in course 783.

Courses 786 to 789 are a repeat of courses 782 to 785 but displaced by one needle to the right.

Referring now to FIG. 23 this illustrates a star tuck structure similar to that illustrated in FIG. 21 except that in the eight course repeat structure of course 798 to 805 a first yarn 806 is always knitted in the leading position and a second yarn 807 is always knitted in the trailing position. It can be seen that when the yarn carrier is moving from right to left as illustrated by arrows 808 and 809, the first yarn 806 is tucked on alternate rear needles and knitted on all front bed needles. Sequentially and immediately afterwards, in the same passage of the cam box, the second yarn 807 is knitted only on all of the needles of the rear needle bed.

In the third course, course 800 when the cam box is moving from left to right, the first yarn 806 is knitted on alternate needles on the rear bed—the same needles as those over which the yarn 806 was tucked in course 798, but is knitted on all of the needles of the front bed. Immediately afterwards the second yarn 807 is then knitted on all of the needles of the rear bed.

Courses 802 to 805 are repeats of courses 798 to 801 but displaced by one needle to the right.

Further examples of apparatus capable of operation to put into practice the invention are to be found in GB-A-2,095,706 and GB-A-2,136,833 or in their US equivalents U.S. Pat. Nos. 4,510,775 and 4,554,802.

GB-A-2,095,706 describes apparatus for varying stitch size to enable the production of textured fabric where stitch transfer occurs, such as in a cable fabric, without imparting unnecessary tension to the yarn. Also where rib and plain stitches are used to make a fabric, rib stitches can be reduced in size and the plain stitches increased in size to produce a uniform stitch density throughout the fabric. GB-A-2,136,833 is concerned with the use of stepping motors to adjust the trailing stitch cam. Neither specification is concerned with upholstery fabric, nor is either specification concerned with balance between adjoined contiguous regions.

What is claimed is:

1. A method of knitting an upholstery fabric having at least two adjoined contiguous regions of different knitted structures located side-by-side in a wale-wise direction and having courses extending continuously through both regions, which comprises knitting said fabric on a machine having a pair of opposed independently operable needle beds, an operating cam box reciprocally movable along the needle beds and containing independently operable cam members for each direction of movement of the cam box, said members having camming surfaces independently adjustable to affect the loop length of stitches knitted on the needles operated by the cam, the needles in each bed being movable independently of one another in their beds into the path of said cam box, and in said knitting actuating the needles for one region by a cam surface of one length in the cam box so as to give stitches with a first loop length, actuating the needles for the adjacent region by a cam surface of a different length in the cam box to give a second loop length different from the first loop length, and adjusting the loop lengths of the two adjacent structures so that, in the relaxed condition of the fabric, the same number of courses of each of the two regions of different knitted structures in the wale-wise direction extend for substantially the same wale-wise distance.

2. A method according to claim 1, wherein there are two camming surfaces in the cam box with the first camming surface controlling the loop lengths in one region and the second camming surface controlling the loop lengths in the adjacent region.

3. A method according to claim 2, wherein the camming surfaces are superimposed one on top of the other so as to engage with butts of different length on the needles.

4. A method according to claim 2, wherein the two camming surfaces are located one above the other in the cam box, the needles of one region being operated by one cam and of the adjacent region by the other cam.

5. A method according to claim 1, comprising altering the cam surface during movement of the cam box whilst knitting so that the camming surface presented to the knitting needles butts for the first region is different from that for the adjacent region.

6. A method according to claim 1, wherein the machine has a needle gauge of from 10 to 14.

7. A method according to claim 1, and comprising employing as first and second yarns air-textured, continuous filament, polyester yarns having a count, in the unrelaxed state, of from 680 to 750 decitex.

8. A method according to claim 7, and comprising employing two yarns are of the same material and having the same count, but differently coloured.

9. A method according to claim 7, wherein the knitting is performed on a 12 gauge machine and comprising adjusting the settings of said stitch cam means so that, in the relaxed state of the finished fabric, the fabric has at least 8 courses per centimeter.

10. A method according to claim 1, wherein there are eight to sixteen courses per cm.

11. A method according to claim 1, wherein there are 4.5 to 6.5 wales per cm.

12. A method according to claim 1, wherein the fabric is a double jersey fabric.

13. A method according to claim 1, comprising knitting said second region with a plurality of differently patterned jacquard structures disposed side-by-side in the fabric.

14. A method according to claim 13, wherein adjacent, differently patterned regions of said second region are separated by a plurality of wales of single or double jersey fabric.

15. A method according to claim 1, and comprising knitting the fabric with one or more regions in addition to said first and second regions, in which one or more regions the knitted structure is different from that of an immediately adjacent region.

16. A weft knitted upholstery fabric having two regions of different structures located side-by-side in a wale-wise direction and having courses extending continuously through both regions, the loop lengths of the structure in one region being different from the loop length of the structure in the other region, thereby to balance the regions of different structure.

17. A fabric as claimed in claim 16 in which the fabric is a double jersey fabric.

* * * * *

UNITED STATES PATENT AND TRADEMARK OFFICE

CERTIFICATE OF CORRECTION

PATENT NO. : 5,255,538

DATED : October 26, 1993

INVENTOR(S) : Gerald F. Day and Frank Robinson

It is certified that error appears in the above—identified patent and that said Letters Patent is hereby corrected as shown below:

Col. 13, line 32, change "wail" to --will--.

Claim 5, Col. 21, line 1, before "comprising", insert --and--.

Signed and Sealed this

Twenty-eighth Day of June, 1994

Bruce Lehman

*Attest:*

BRUCE LEHMAN

*Attesting Officer*

*Commissioner of Patents and Trademarks*